US008650673B1

(12) United States Patent
Goettl

(10) Patent No.: US 8,650,673 B1
(45) Date of Patent: Feb. 18, 2014

(54) SWIMMING POOL DRAIN

(75) Inventor: John M Goettl, Scottsdale, AZ (US)

(73) Assignee: GSG Holdings, Inc., Chandler, AZ (US)

( * ) Notice: Subject to any disclaimer, the term of this patent is extended or adjusted under 35 U.S.C. 154(b) by 923 days.

(21) Appl. No.: 11/924,142

(22) Filed: Oct. 25, 2007

Related U.S. Application Data

(63) Continuation of application No. 10/894,803, filed on Jul. 20, 2004, now abandoned, which is a continuation-in-part of application No. 10/144,899, filed on May 14, 2002, now Pat. No. 6,810,537.

(51) Int. Cl.
*E04H 4/00* (2006.01)
*E04H 4/12* (2006.01)

(52) U.S. Cl.
CPC ..... *E04H 4/12* (2013.01)
USPC ..... 4/507

(58) Field of Classification Search
CPC ..... E04H 4/12
USPC ..... 4/504, 507, 509; 210/167.16; 52/169.7; 249/DIG. 3
See application file for complete search history.

(56) References Cited

U.S. PATENT DOCUMENTS

| | | | | |
|---|---|---|---|---|
| 1,454,310 | A | 5/1923 | Booraem | |
| 1,584,453 | A | 5/1926 | Hess | |
| 1,792,345 | A | 2/1931 | Williams | |
| 2,003,770 | A | 6/1935 | Goodhart | 182/31 |
| 2,695,678 | A | 11/1954 | Sisk | 182/31 |
| 2,749,999 | A | 6/1956 | Schmid | 182/31 |
| 2,777,532 | A | 1/1957 | Sisk | 182/31 |
| 3,247,968 | A | 4/1966 | Miller | 210/136 |
| 3,247,969 | A | 4/1966 | Miller | 210/169 |
| 3,313,515 | A * | 4/1967 | Mullen, Jr. | 249/DIG. 3 X |
| 3,378,858 | A | 4/1968 | Jacuzzi | 4/172 |
| 3,408,006 | A | 10/1968 | Stanwood | 239/66 |
| 3,486,623 | A | 12/1969 | Bosico | 210/169 |
| 3,506,489 | A | 4/1970 | Baker | 134/10 |
| 3,675,252 | A | 7/1972 | Ghiz | 4/172.17 |
| 3,703,302 | A | 11/1972 | Demler | 285/161 |
| 3,940,807 | A * | 3/1976 | Baker et al. | 4/504 X |
| 4,114,206 | A | 9/1978 | Franc | 4/172 |
| 4,115,878 | A * | 9/1978 | Johnson et al. | 4/509 X |

(Continued)

OTHER PUBLICATIONS

Maricopa County Environmental Health Code, Chapter VI, Bathing Places—Public and Semipublic Swimming Pools, Sectioon 3, General Design Standards and Specifications, revision date Feb. 18, 2004, pp. 6-17 thru 6-24.*

(Continued)

*Primary Examiner* — Lori Baker
(74) *Attorney, Agent, or Firm* — Booth Udall Fuller, PLC

(57) ABSTRACT

A sump for a swimming pool or spa includes a grate having an elongated slot for inflow of water at a low velocity high flow rate. A housing includes an outlet for conveying water to an oversized suction line to maintain the low velocity high flow rate to the junction with a conventionally sized standard suction line in fluid communication with a suction pump. A bypass line discharges water into the housing when the slot is covered to thereby prevent suction at the slot sufficient to entrap a swimmer against the grate. The grate, a frame supporting the grate on the housing and the housing are devoid of elements that might cause entanglement of hair drawn into the sump. A hydrostatic valve may be coupled with the housing.

11 Claims, 33 Drawing Sheets

(56) References Cited

U.S. PATENT DOCUMENTS

| | | | | |
|---|---|---|---|---|
| 4,460,462 | A | 7/1984 | Arneson | 210/163 |
| 4,487,219 | A | 12/1984 | Makela et al. | 137/362 |
| 4,503,573 | A | 3/1985 | Handzel | 4/507 |
| 4,505,814 | A | 3/1985 | Marshall | 210/166 |
| 4,561,134 | A | 12/1985 | Mathews et al. | 4/496 |
| 4,907,610 | A | 3/1990 | Meincke | 134/56 |
| 4,910,811 | A | 3/1990 | Izzi, Sr. | 4/292 |
| D319,295 | S | 8/1991 | Ohaus | D23/261 |
| 5,135,579 | A | 8/1992 | Goettl | 134/10 |
| 5,265,631 | A | 11/1993 | Goettl | 134/111 |
| 5,268,096 | A | 12/1993 | Robol | 210/164 |
| 5,341,523 | A | 8/1994 | Barnes | 4/507 |
| 5,408,706 | A | 4/1995 | Barnes | 4/507 |
| 5,799,339 | A | 9/1998 | Perry et al. | 4/286 |
| 5,822,807 | A | 10/1998 | Gallagher et al. | 4/507 |
| 5,878,773 | A | 3/1999 | Robol | 137/112 |
| 5,947,700 | A | 9/1999 | McKain et al. | 417/306 |
| 5,978,981 | A | 11/1999 | Nelson | 4/541.1 |
| 5,991,939 | A | 11/1999 | Mulvey | 4/504 |
| 6,088,842 | A | 7/2000 | Barnett | 4/286 |
| 6,098,654 | A | 8/2000 | Cohen et al. | 137/467 |
| 6,170,095 | B1 * | 1/2001 | Zars | 4/507 |
| 6,341,387 | B1 | 1/2002 | Zars | 4/504 |
| 6,419,840 | B1 | 7/2002 | Meincke | 210/767 |
| 6,438,766 | B1 | 8/2002 | Arnau | 4/490 |
| 6,810,537 | B1 * | 11/2004 | Barnes et al. | 4/507 |

OTHER PUBLICATIONS

CSI, Leaf Trapper Main Drain System Installation Bulletin, no publication year listed.

* cited by examiner 410
18
84
416
204
206
30
86
412
426
458
424
434
436
432
430
440
438
442
444
446
466
450
452
474
472
473
475
476
473
460
478
454
464
456
462

SWIMMING POOL DRAIN

CROSS REFERENCE TO RELATED APPLICATIONS

The present application is a continuation application of U.S. patent application entitled "SWIMMING POOL DRAIN," to Goettl, et al., Ser. No. 10/894,803, filed Jul. 20, 2004, which application is a continuation-in-part application of U.S. Pat. No. 6,810,537 entitled "POOL FLOOR DRAIN ASSEMBLY FOR A SUCTION-ACTIVATED WATER CIRCULATION SYSTEM", to Goettl, et al., Ser. No. 10/144,899 filed May 14, 2002, the disclosures of which are hereby incorporated herein by reference.

BACKGROUND

1. Field of the Invention

The present disclosure relates to drains for swimming pools and, more particularly to drains that will not permit entrapment of persons, their clothing or their hair thereagainst.

2. Description of Related Art

Most swimming pools and spas, whether of concrete/gunite, fiberglass or having a vinyl liner above ground or in ground, include a drain at the lowest point. The purpose of the drain is to provide an outlet for flow of water from the swimming pool to the suction side of a pump. The outflow of the pump is passed through a filter to remove entrained matter. The filtered water is returned to the swimming pool at above and/or below water level outlets in the pool. Usually, the suction line from the drain includes a debris trap upstream of the pump to collect large sized debris.

The drain itself includes an apertured cover for passing water therethrough but prevents the inflow of large sized debris as a function of the size of the apertures or slots in the drain cover. A high flow rate of the water through the suction line is desirable to filter a large quantity of water within a given time period to help maintain clarity of the water. A high flow rate through the drain cover can only be brought about by maintaining a high suction force beneath the drain cover in order to draw water through the apertures of the drain cover. Such high suction force creates a potentially severe health hazard to a user of the pool or spa.

If a person were proximate the drain cover and a body part of the person came close to the drain cover, the suction force present would tend to draw the body part against the drain cover. Once the drain cover is covered by the body part, significant force by the person would be required to move away from the drain. Particularly children and those persons physically enfeebled may not have the requisite strength or capability to overcome the suction force acting upon them; as a result, they are likely to drown.

If a person in a swimming pool or spa wears loose clothing and comes into proximity with the drain of a swimming pool or spa, the material of the clothing may be drawn into or cover the drain. In such event, the suction force acting upon the material may be sufficient to prevent the person from moving away from the drain. For persons with long full hair, the hair is readily drawn into the swimming pool/spa drain and may twist upon itself beneath the drain cover to the extent that extraction becomes impossible. The potential consequences of both clothing and hair becoming entrapped by the drain in a swimming pool or spa may be fatal.

SUMMARY

A swimming pool or spa sump having a housing and a grate is provided which has low velocity, high volume waterflow into the suction line in fluid communication with a suction pump. The grate includes a single relatively large sized aperture or slot sufficient to permit debris to pass therethrough and generally preclude more than partial insertion of a swimmer's fingers or toes. The housing downstream of the grate is relatively large sized and includes a large sized outlet in communication with an oversized suction pipe ultimately connected to a conventionally sized suction line. An inlet to the sump is in fluid communication with a bypass line extending from, for example, an opening in the sidewall of the swimming pool or spa to provide an alternate flow path into the sump in the unlikely event the grate were to be sufficiently covered by a body part or clothing of a person to impede flow into the sump sufficient to accommodate the rate of outflow through the suction line. For locations having a high level of ground water, a hydrostatic tube may be incorporated to permit flow of ground water into the swimming pool and prevent an empty or near empty swimming pool from floating.

It is therefore a primary object of the present invention is to provide a drain for a swimming pool or spa which will not entrap a person thereagainst.

Another object of the present invention is to provide a sump and grate attendant a drain for a swimming pool or spa that will permit easy withdrawal of an article of clothing or hair that may be drawn into the sump through the grate.

Another object of the present invention is to provide a high flow rate low velocity drain for a swimming pool or spa.

Yet another object of the present is to provide a single apertured grate for a swimming pool or spa drain sump.

Still another object of the present invention is to provide a sump for a swimming pool or spa drain having an outlet in fluid communication with the suction line, an inlet in fluid communication with a bypass line and an inlet supporting a hydrostatic valve in fluid communication with the pool water.

A further object of the present invention is to provide a sump and grate adaptable for use in a concrete/gunite pool or spa, a fiberglass pool or spa or a vinyl lined pool or spa.

A yet further object of the present invention is to provide one of a plurality of configurations of a sump and a grate for use as a drain in a swimming pool or spa and having a large flow rate low velocity water outflow.

A still further object of the present invention is to provide a method for preventing the suction attendant the drain of a swimming pool or spa from entrapping a person against the drain.

These and other objects of the present invention will become apparent to those skilled in the art as the description thereon proceeds.

BRIEF DESCRIPTION OF THE DRAWINGS

Particular implementations of a swimming pool drain will be described with greater specificity and clarity with reference to the following drawings, in which.

DESCRIPTION

Figure 1:
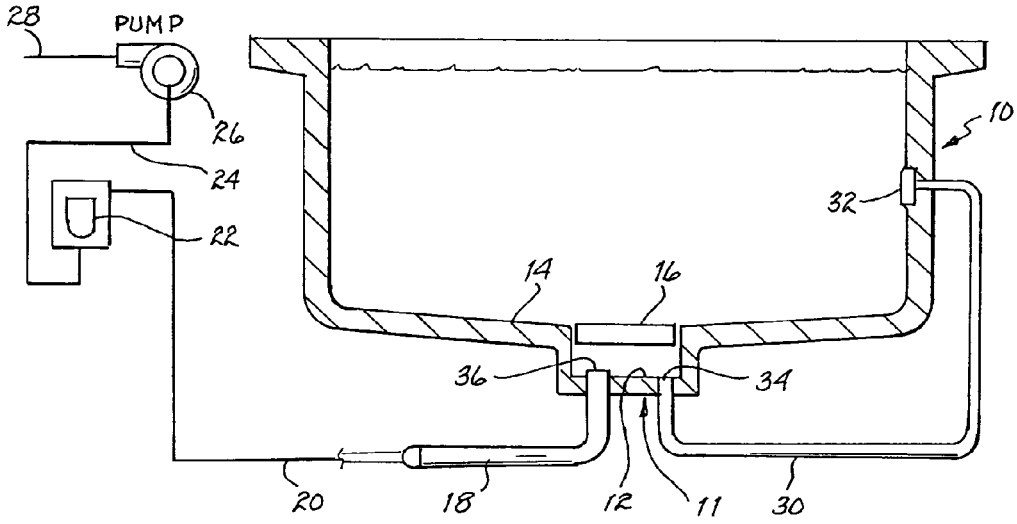
FIG. 1 is a representative cross sectional view of a swimming pool incorporating the drain structure of the present invention.

Referring to FIG. 1, there is illustrated a representative cross section of a swimming pool 10 having drain 11. The drain is formed in the cementitious material defining the pool and includes a sump 12 generally located at the low spot in bottom 14 of the pool. It is to be understood that the drain may be elsewhere in the bottom or in a wall of the pool or a spa. While the discussion below is primarily directed to various sumps useable in swimming pools, these sumps could also be used in spas and the like. A preformed grate 16 is disposed and retained at the inlet to the sump and incorporates one or more, but preferably one aperture for inflow of water to the sump. A suction line 18 of relatively substantial diameter extends from sump 12. It is connected to a conventionally sized suction line 20 in fluid communication with a conventional debris trap 22. A further suction 24 extends from the debris trap to the inlet in pump 26. Outflow from the pump through return line 28 is channeled back into pool 10 in any one of several conventional manners. The combination of suction lines 18, 20 and 24 represent the suction lines for drawing water from the pool through grate 16 and sump 12. A bypass line 30 is in fluid communication with sump 12 and extends from the sump to a location in pool 10 remote from grate 16. Usually, an inlet 32 to bypass line 30 is disposed in a wall of the pool. Bypass line 30 serves in the manner of a relief line to provide a source of water to sump 12 in the event grate 16 becomes fully or partially blocked and thereby accommodates flow into suction line 18. It may be noted that outlet 34 of the bypass line is disposed at one end of sump 12 and inlet 36 of the suction line 18 is disposed at the other end of the sump.

Figure 2:
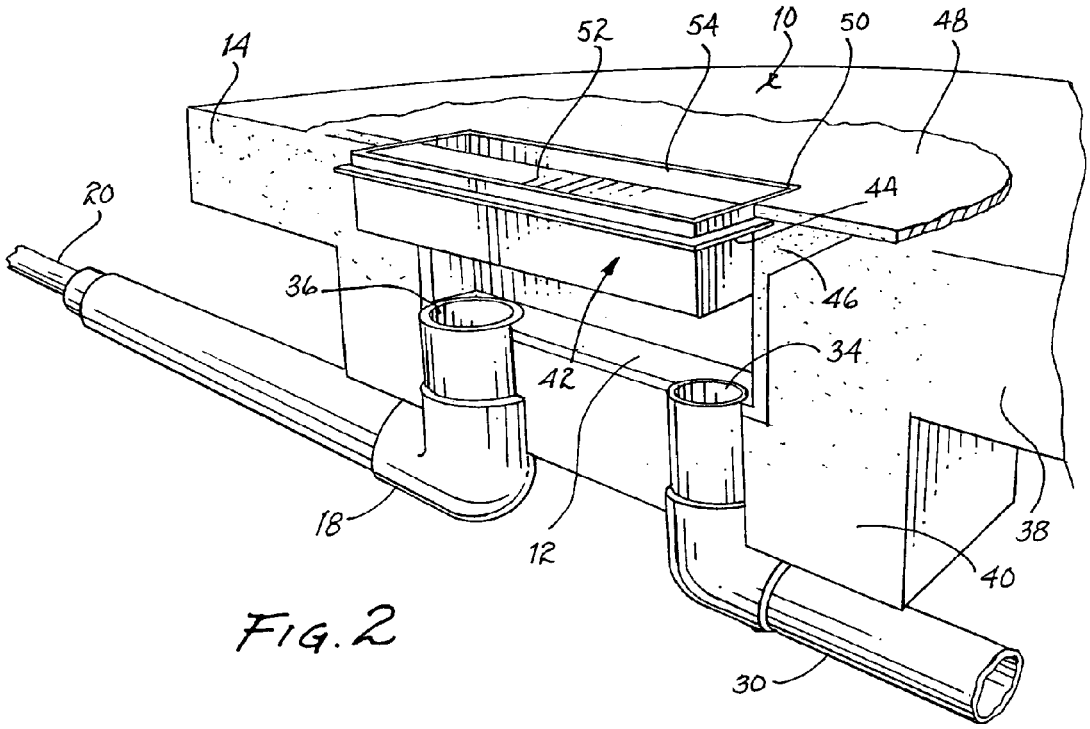
FIG. 2 is a partial cutaway view of certain components of the sump.

Turning to FIG. 2, further details of the sump and its relationship to the pool will be described. Pool 10 may be formed in any of innumerable shapes and is usually either of cementitious or fiberglass material. The pool shown in FIG. 2 is formed of cementitious material 38 defining bottom 14 of the pool and a sump 12 is formed within the cementitious material and illustrated as a block 40 to provide the requisite strength and support for the elements associated therewith. It is to be understood that the sump could be formed in a wall of the pool. Suction line 18, is sealed within block 40 with inlet 36 protruding into sump 12. Similarly, bypass line 30 is sealed within block 40 with outlet 34 located within the sump. A preformed frame 42 extends into sump 12 and includes a circumscribing ledge 44 to secure the frame with the cementitious material defining the sump. Alternatively, a setting material 46 may coat the sump defined by the cementitious material of block 40. In such event, frame 42 would be retained by the setting material. Generally, most pools include a coating 48, usually plaster, which is applied to an elevation commensurate with top edge 50 of frame 42. A preformed grate 52 is removably disposed within the frame 42 (which grate is representatively identified by numeral 16 in FIG. 1). As further shown in FIG. 3, grate 52' includes an elongated slot 54' extending essentially for the full length of sump 12. The grate may be attached to frame 42 by screws 56, or the like, disposed at each corner.

Slot 54, 54' is sized to accommodate the design flow rate for the suction line. To accommodate large debris removal, the width of the slot is in the range of about 1 to about 0.625 inches. Normally, the width of the slot should be limited to approximately 0.75 inches to prevent body parts, such as hands or fingers, from intruding very far into the sump. The length of slot 54, 54' is variable and is a function of the design flow rate which is preferably 1.5 feet per second. For example, a drain system designed for a flow rate of 60 gallons per minute (GPM), a slot width of 0.75 inches will require a slot length of 17 inches to produce a velocity of 1.5 feet per second through the slot. This results in a relatively low velocity of water flow through the slot and a very small pressure drop in the chamber or housing of the sump. This low flow velocity permits easy retrieval of hair or any clothing or part of clothing that may have entered the sump or even the expanded suction line downstream of the sump.

For reasons which will become apparent below, suction line 18 is oversized from that of the conventional size of pool suction lines. Preferably, the interior diameter of conduit 18 is sized to provide a low velocity water flow; a diameter of 4 inches would be representative. For example, the size should be sufficient to maintain a flow velocity of approximately 1.5 feet per second at a 60 gallons per minute (GPM) rate and this velocity will remain essentially constant to the junction of suction line 18 with a much smaller and conventionally sized suction line 20. Within suction line 20, the flow velocity may increase to 6 feet per second, as is normal. The total length of low velocity flow from slot 54, 54' in grate 52, 52' to suction line 20 should be long enough to insure that any length of hair a swimmer may have or length of clothing used by a swimmer and that may be drawn into the sump will not reach suction line 20. Thereby, the "suction" acting upon such hair or clothing will be relatively low and withdrawal of same is readily accomplished. By experimentation, it has been learned that a low velocity zone of 24 to 30 inches in length provides ample protection to prevent a bather from becoming entrapped at the grate.

It is to be noted that each of the embodiments of the sumps described herein is devoid of elements that might cause entanglement of long hair drawn into the sump through the slot. That is, neither the grate, the supporting frame nor the housing have any protrusions or slots about which strands of hair may wrap and thereby become impossible to extricate.

When pump 26 (see FIG. 1) is actuated, suction within suction line 18 is translated into suction within sump 12. Because inlet 36 of the suction line is close to one end of slot 54 in the grate, the flow from the pool will be greatest at that end of the slot and diminish toward the other end of the slot. Should slot 54 become blocked, the flow from the pool may be reduced or even stopped. In such event, water will be drawn through bypass line 30 and this flow is discharged through outlet 34 into the sump. Thereby, such bypass flow will satisfy the flow requirements established by pump 26 and a high suction condition at slot 54 is avoided. Thus, were a swimmer to fully cover the slot, entrapment would not occur as the suction present within sump 12 would be relieved by outflow of water through outlet 34. Moreover, the length of slot 54 is unlikely to be completely covered by a swimmer which is not true with respect to conventional circular or square inlets in drain covers.

Figure 3:
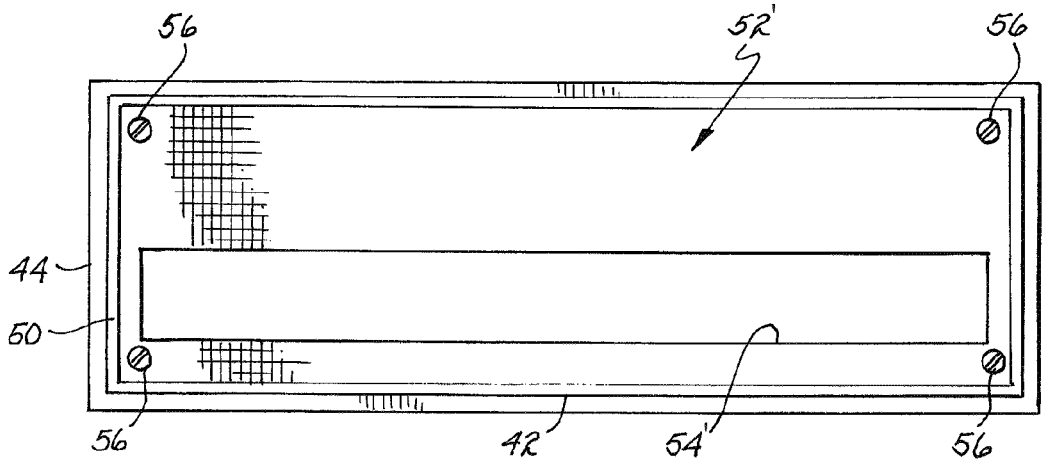
FIG. 3 is a top view of the grate for the sump.
Figure 4:
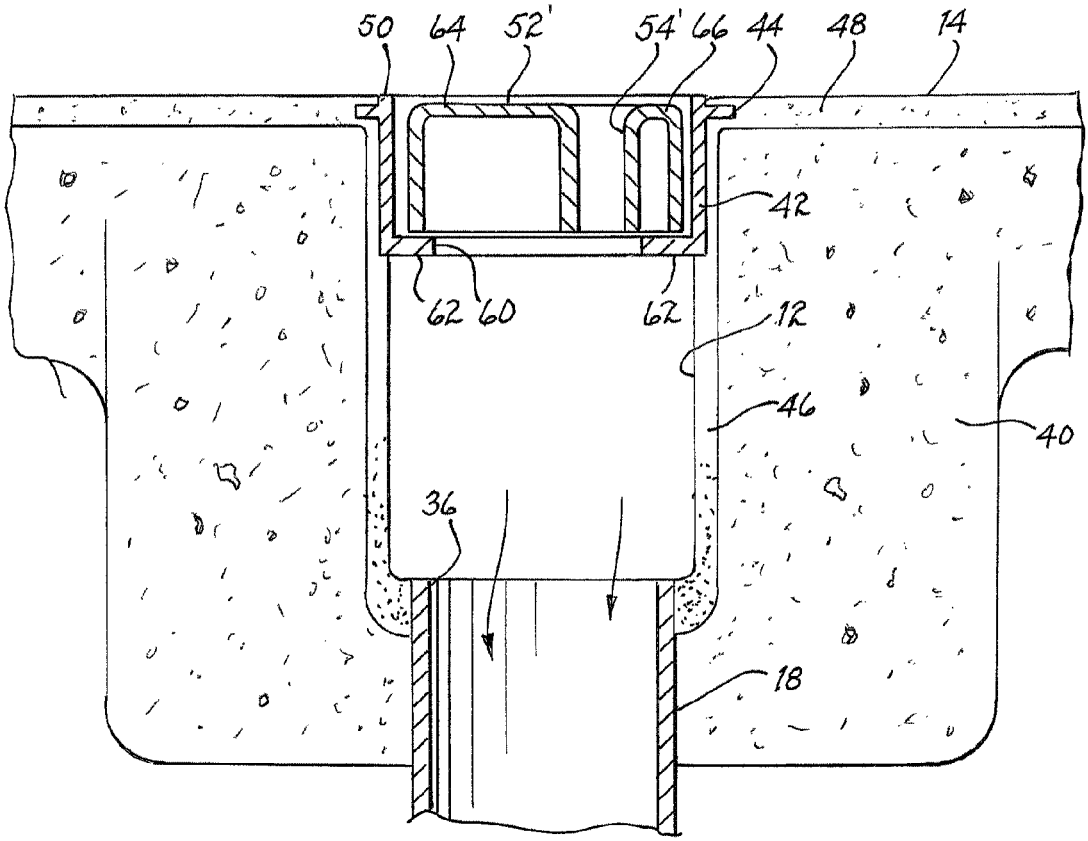
FIG. 4 is a cross sectional view of the sump.

FIG. 4 is a partial cross sectional view of the drain and its components, as shown in FIG. 2. Setting material 46 seals the exterior surface of suction line 18 within the hollow representing sump 12 disposed within block 40 defining bottom 14 of the pool. Frame 42 and its peripheral ledge 44 is lodged within and retained by setting material 46 to locate top edge 50 of the frame essentially coincident with the exposed surface of coating 48 covering the cementitious material and defining the surface of the bottom of the pool. The frame includes a central opening 60 defined by an inwardly extending peripheral flange 62. The flange provides support for grate 52' and locates the upper surface of the grate coincident with the surface of bottom 14. As shown in this view, slot 54' is defined by two inverted U-shaped elements 64, 66 as illustrated. The lower end of slot 54' is coincident with opening 60 to permit unimpeded flow through and out of the slot into sump 12. As illustrated in FIG. 3, screws or the like may be used to retain the grate within a frame 42. It may be noted that the shape of U-shaped elements 64, 66 render the grate sufficiently robust to withstand any forces or weight that might normally by imposed thereon.

Figure 5:
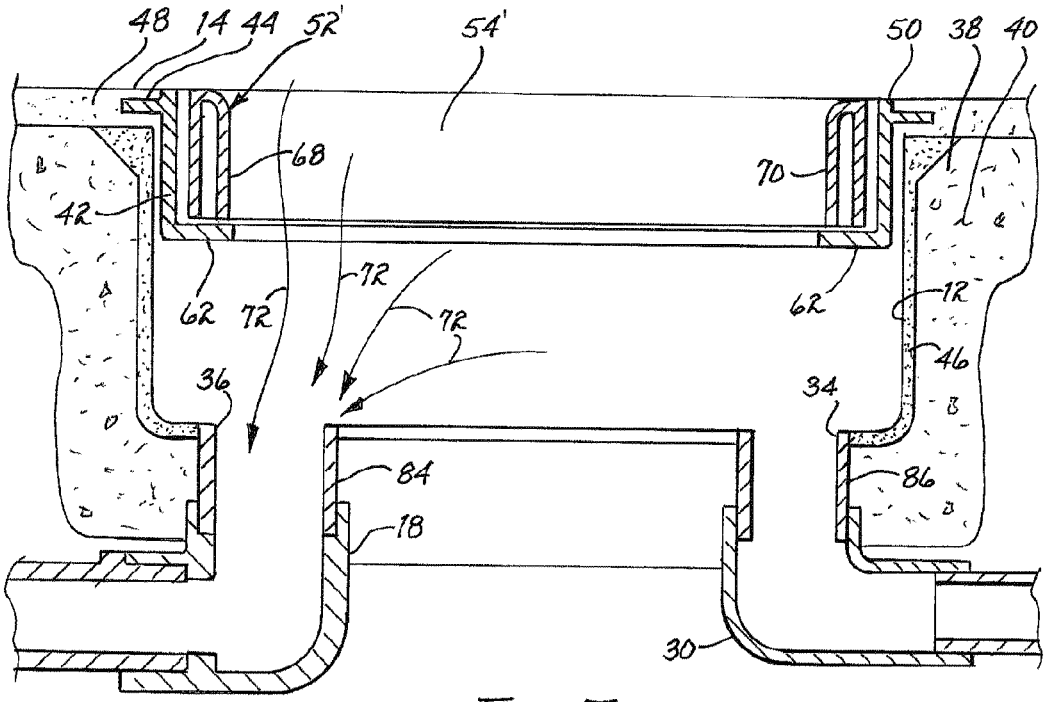
FIG. 5 is a further cross sectional view of the sump.

FIG. 5 is a further cross sectional view taken orthogonally to the view shown in FIG. 4. The opposite ends of grate 52', along with the longitudinal sides shown in FIG. 4, are supported upon flange 62 of frame 42. Elements 68, 70 define the ends of grate 52' and are formed in the manner of inverted U's in cross section to provide the requisite stability and robustness. Arrows 72 generally illustrate the flow of water through slot 54' into inlet 36 of suction line 18. That is, most of the flow through slot 54' occurs proximate element 68 and the flow rate is reduced toward element 70. Under normal circumstances, little flow, if any occurs through bypass line 30 into sump 12 through outlet 34 from the pool as the flow through the grate satisfies the pump suction requirements.

Referring jointly to FIGS. 6, 7, 8, 9 and 10, there is shown a preformed sump 80 for lodgement in cementitious material 38 forming the shell of the pool. Sump 80 includes a hollow box like housing 82 having hollow bosses 84, 86 extending downwardly from bottom 88. Boss 84 is interconnected with suction line 18 and boss 86 is interconnected with bypass line 30. As illustrated, boss 84 is of significantly greater cross sectional area than boss 86 in view of their very distinct and different functions. Housing 82 includes a laterally expanded sides 90, 92 defining interior ledges 94, 96. A peripheral flange 98 extends outwardly from housing 82 for mechanical locking engagement with cementitious material 38 surrounding sump 80. Thereby, the sump is immovably mounted within the shell of the pool. A frame 42, like the frame discussed above, is slidably inserted through opening 100 at the top of housing 82. To permit variation in the degree of insertion of frame 42 into housing 82, the frame includes a downwardly extending peripheral wall 102. Ledge 44 encircles frame 42 for locking engagement with the setting material or the coating, such as plaster, forming the surface of the bottom of the pool. Grate 52 is like the grate discussed above and slidingly mates with and is supported by the frame, as discussed above.

Figure 6:
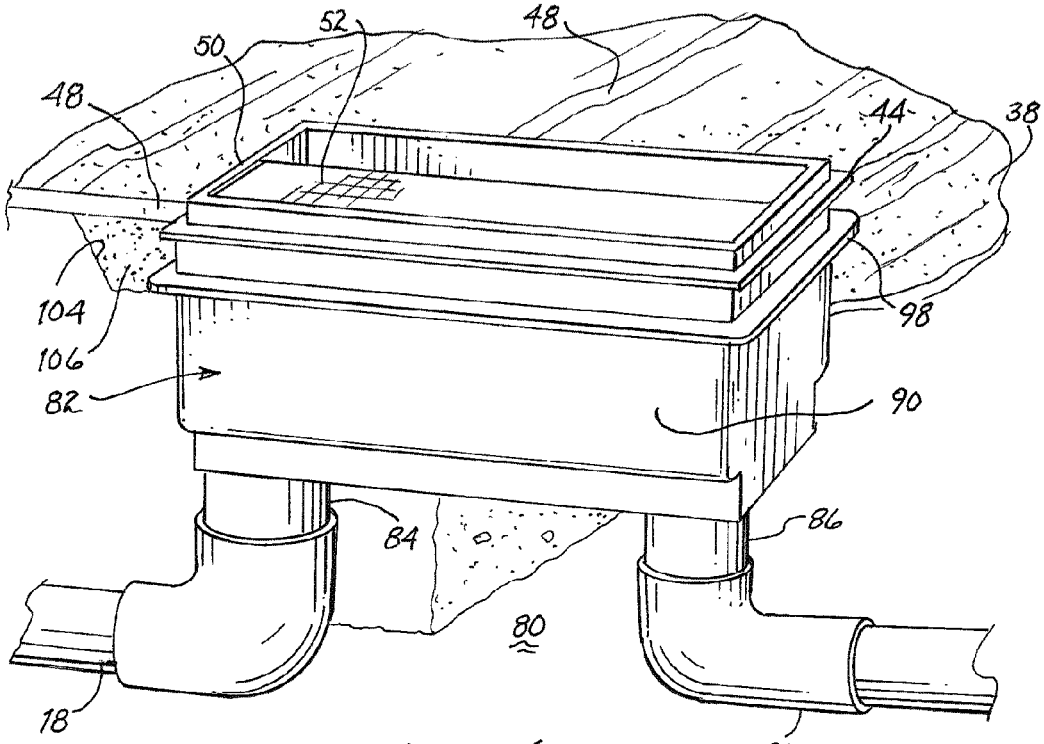
FIG. 6 is a partial cutaway view of the concrete in which a first variant preformed sump is imbedded.
Figure 7:
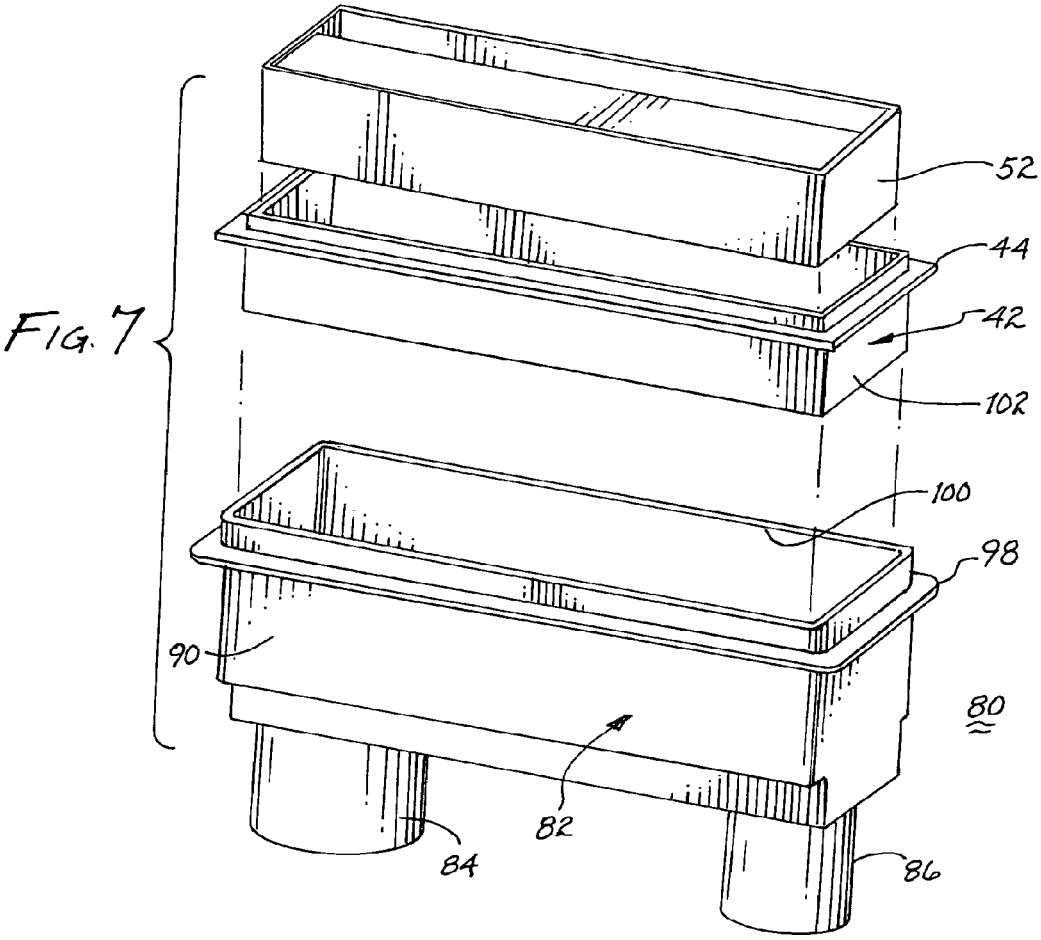
FIG. 7 is an exploded view illustrating major components of the sump.
Figure 8:
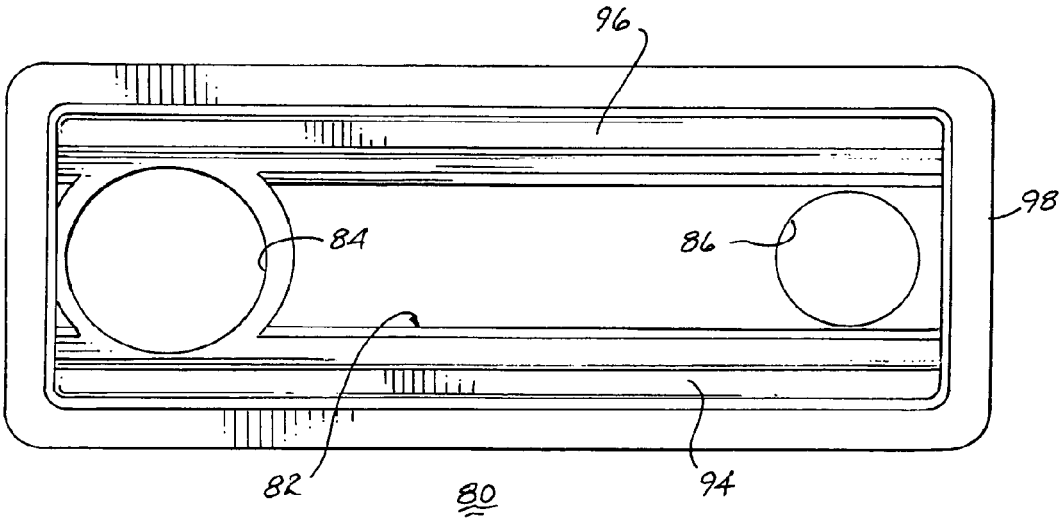
FIG. 8 is a top view of the preformed housing embodied in the sump.
Figure 9:
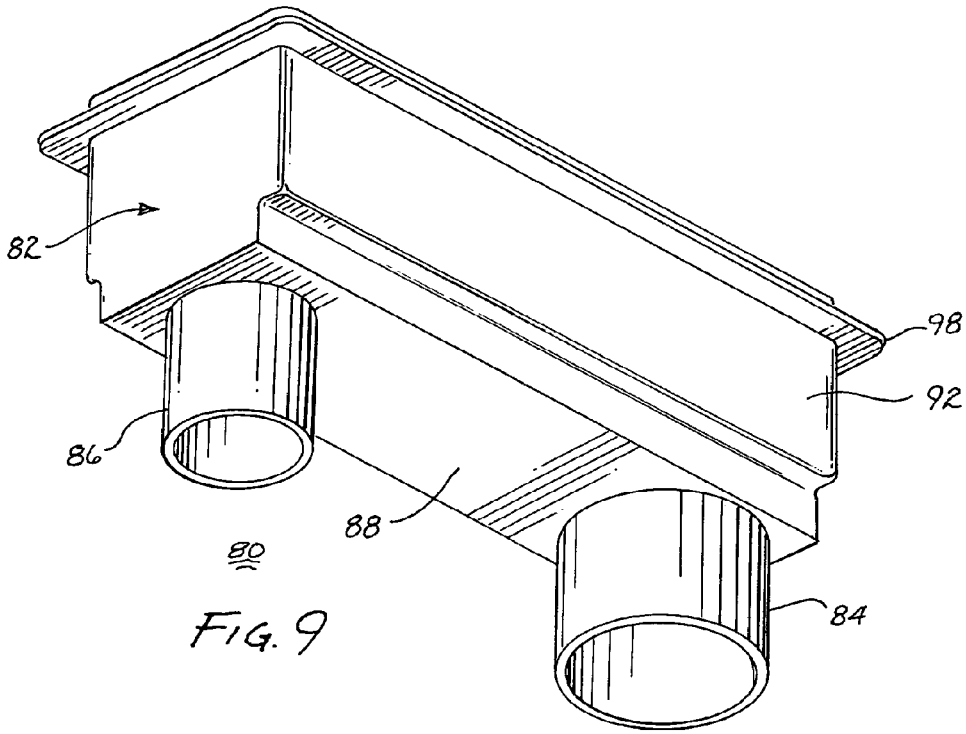
FIG. 9 is an isometric view of the bottom and side of the sump.
Figure 10:
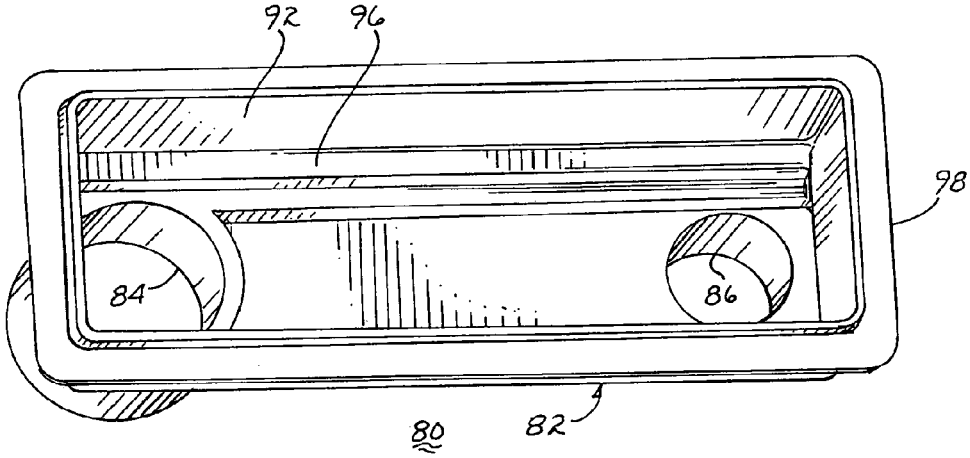
FIG. 10 is an isometric view of the interior of the sump.

During installation, preformed sump 80 is set in place and secured to suction line 18 and bypass line 30. Thereafter, cementitious material 38 is poured thereabout in a conventional manner. As shown in FIG. 6, the cementitious material may extend upwardly at an angle to define a slope 104 extending around housing 82. Thereafter, the space defined by this slope may be packed with setting compound 106 in the conventional manner. Frame 42 is then inserted into the housing at a height commensurate with the surface of finish coating 48. As noted, wall 102 forming a part of the frame permits significant vertical and canting adjustment to insure that edge 50 of the frame is in the plane of the surface of the coating. Grate 52 is placed within and secured to frame 42.

Figure 11:
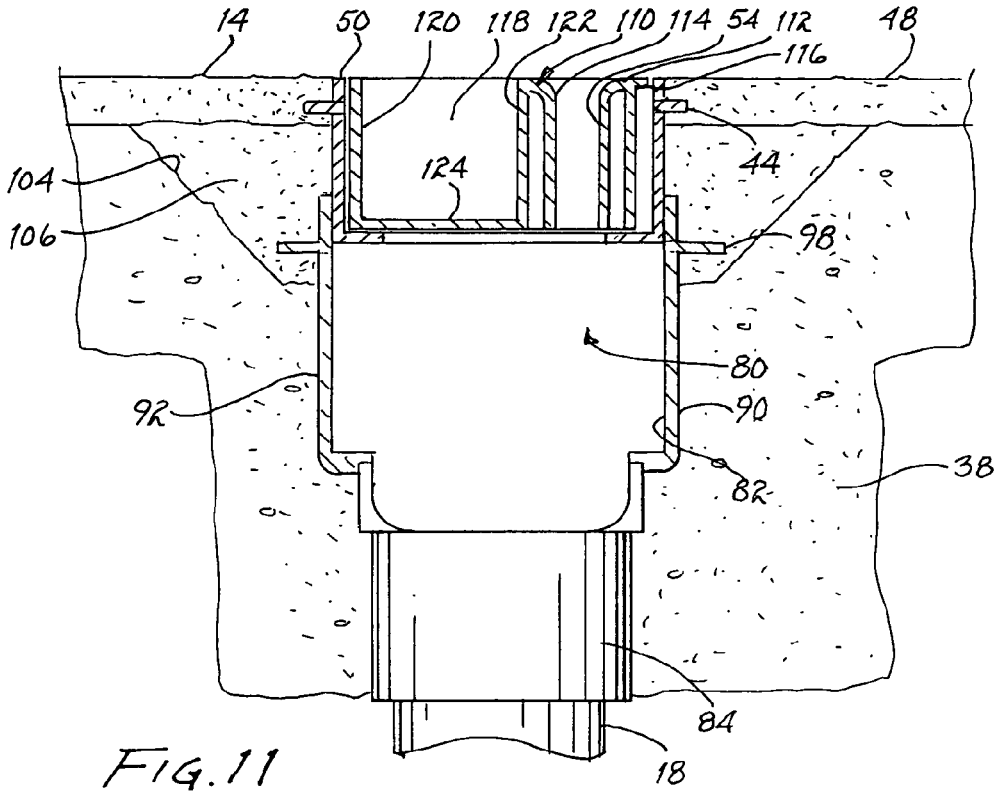
FIGS. 11 and 12 illustrate mounting of the components of the sump to accommodate different finish elevations of the bottom of the swimming pool.
Figure 12:
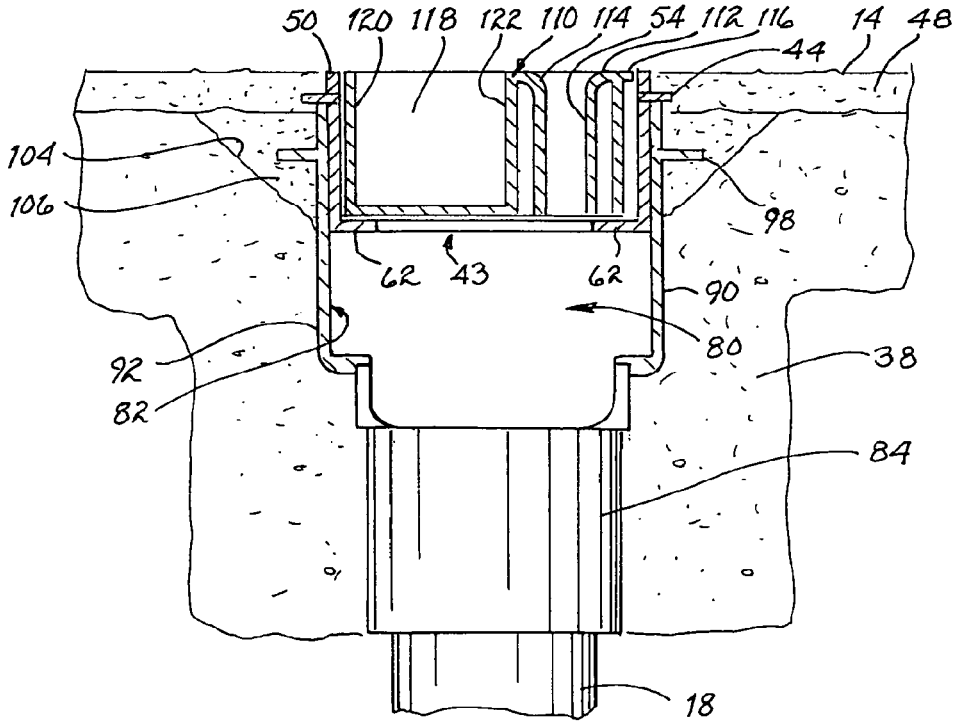
Figure 13:
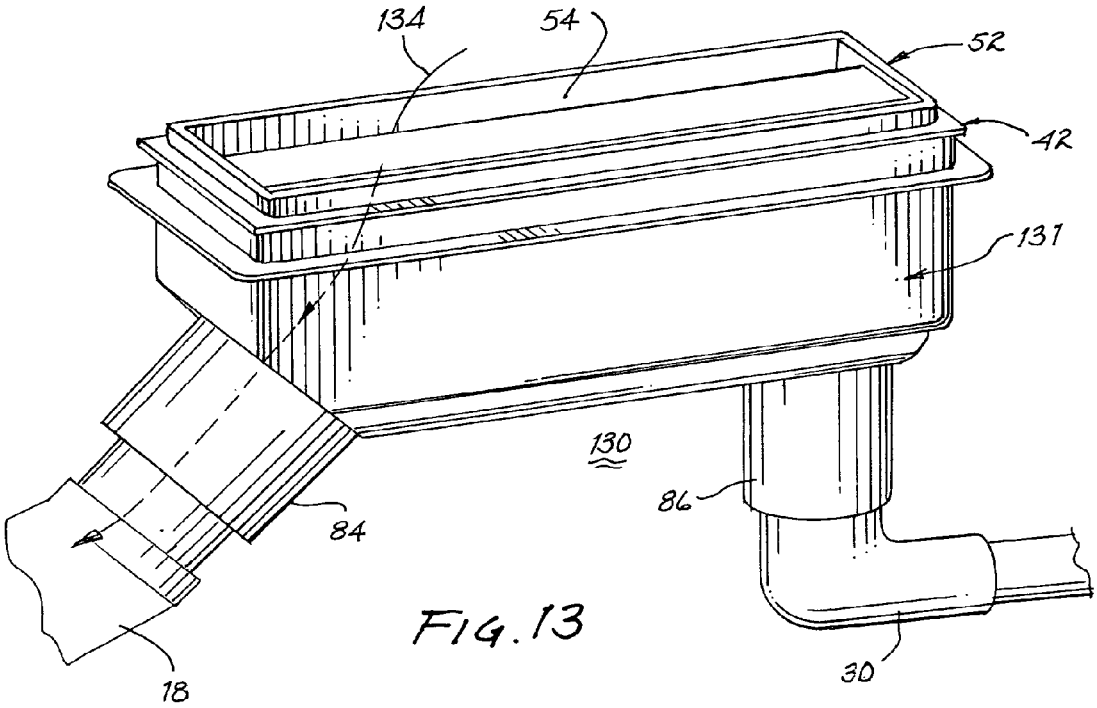
FIG. 13 illustrates a second variant configuration of a preformed sump.
Figure 13A:
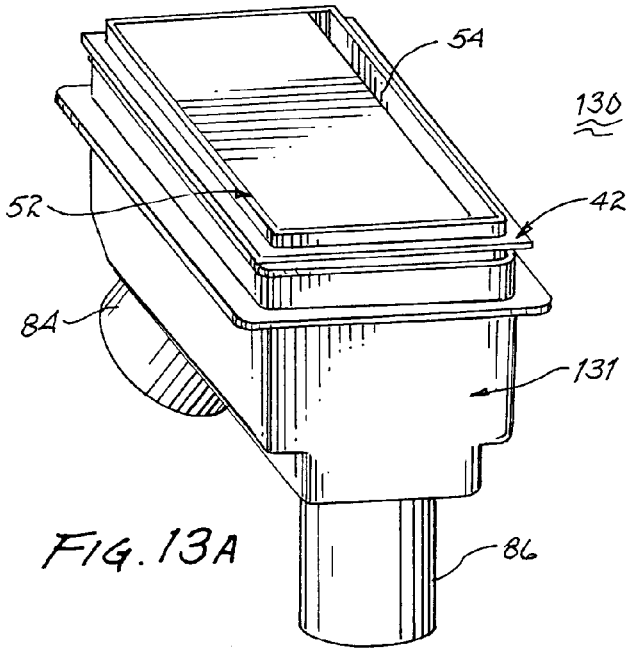
FIG. 13A illustrates an end view thereof.

Referring jointly to FIGS. 11 and 12, there are shown two versions of installation of preformed sump 80 in a shell of a pool or spa formed of cementitious material. Furthermore, a different version of a grate is illustrated and will be described. FIG. 11 illustrates locating the preformed sump deeply within cementitious material 38 relative to finished bottom 14 of the pool. To accommodate this depth, frame 42 is raised with respect to housing 82 to locate its upper edge 50 in the plane of bottom of the pool. Grate 110 includes elements 112, 114 that define slot 54. These elements extend longitudinally along the grate as discussed above. Although not shown in detail, equivalent elements form the ends of slot 54 as earlier described. Element 112 may include a lip 116 to close the gap with the side of frame 42. Element 114, like element 112, is generally in the shape of an inverted U. Furthermore, element 114 may be adapted to define a cavity 118 circumscribed by walls 120, 122, bottom 124 and end walls.

The purpose of this cavity would be to permit insertion of finishing compound 126 to reduce the visual impact of the drain. In the installation configuration shown in FIG. 12, preformed sump 80 is located within cementitious material 38 relatively close to bottom 14 in comparison to the installation shown in FIG. 11. Herein, frame 42 is lowered into the housing to the extent that ledge 44 essentially rests against the top of sides 90, 92. Thereby, the interrelationship between frame 42 and housing 82 permits variation in depth of location of the sump without compromising locating the grate in the plane of bottom 14 of the pool.

Figure 14:
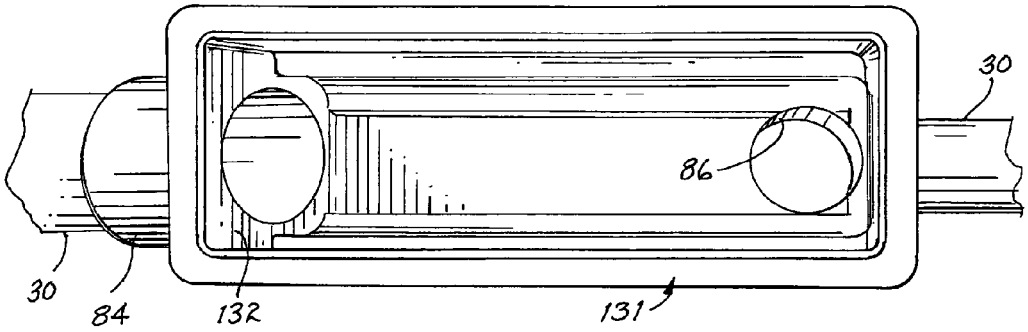
FIG. 14 is a top view of the sump shown in FIG. 13 and FIGS. 14A, 14B and 14C illustrate cutaway views thereof.
Figure 14A:
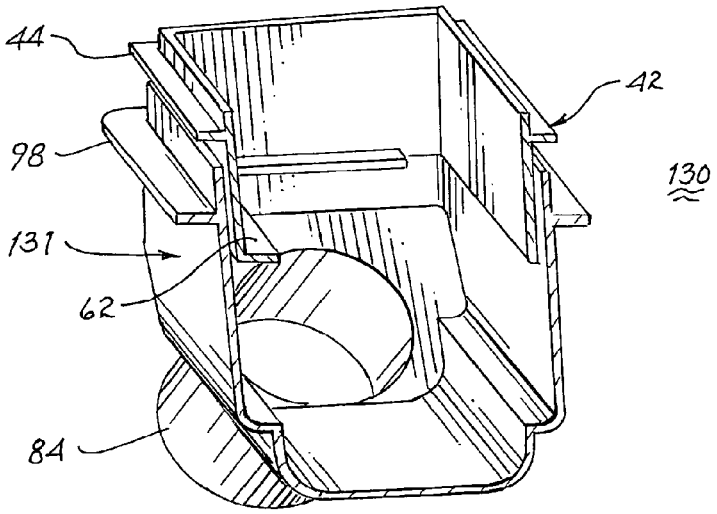
Figure 14B:
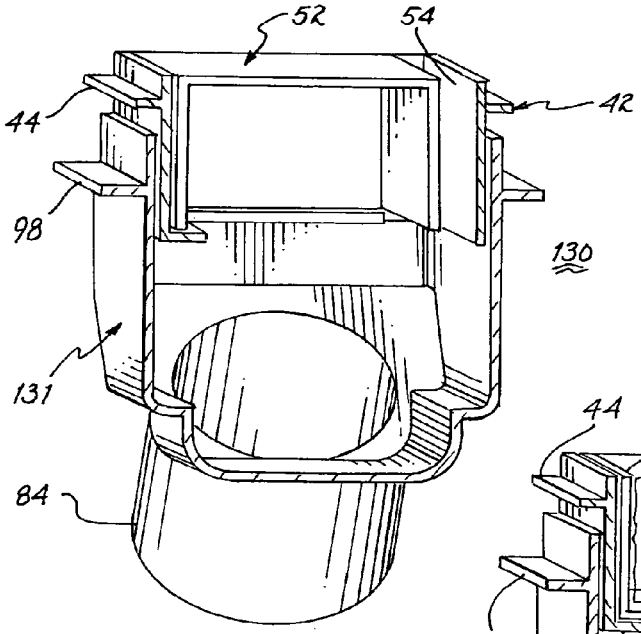
Figure 14C:
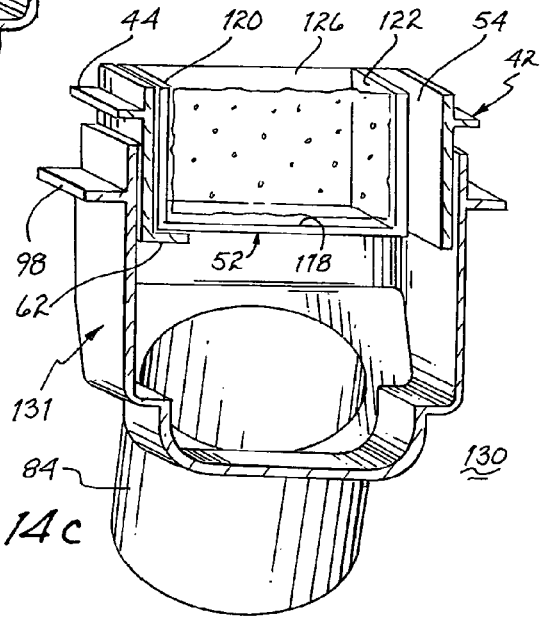

FIGS. 13, 13A, 14, 14A, 14B and 14C illustrate a second variant preformed sump 130 having a housing 131 for receiving and supporting a frame 42 and a grate 52 discussed above. For the sake of brevity, only the differences between sump 130 and sump 80 will be described and common reference numerals will be used. At some locations, vertical depth below the sump may be a problem on installation. Secondly, by minimizing the number of right angle flows, the debris coming through the drain will more readily pass and reduce the likelihood of clogging. And, it is less likely to entrap hair or clothing. Accordingly, the discharge end of housing 131 includes an angled side 132 for supporting boss 84. The boss is connected to suction line 18 by suitable angled fittings. As depicted by arrow 134, the flow from the sump into boss 84 and suction line 18 is more smooth than the flow attendant sump 80. Furthermore, it is likely that the rate of flow through slot 54 has a lower gradient of flow rate from the end commensurate with boss 84 to the end commensurate with boss 86. Moreover, such inclined orientation of boss 84 permits easier removal of debris that may have been drawn into suction line 18. As shown in FIG. 14C, grate 52 may include an upwardly open cavity 118 for receiving a finishing compound 126 to minimize the visually perceived presence of the elements of the sump in the pool or spa.

Figure 15:
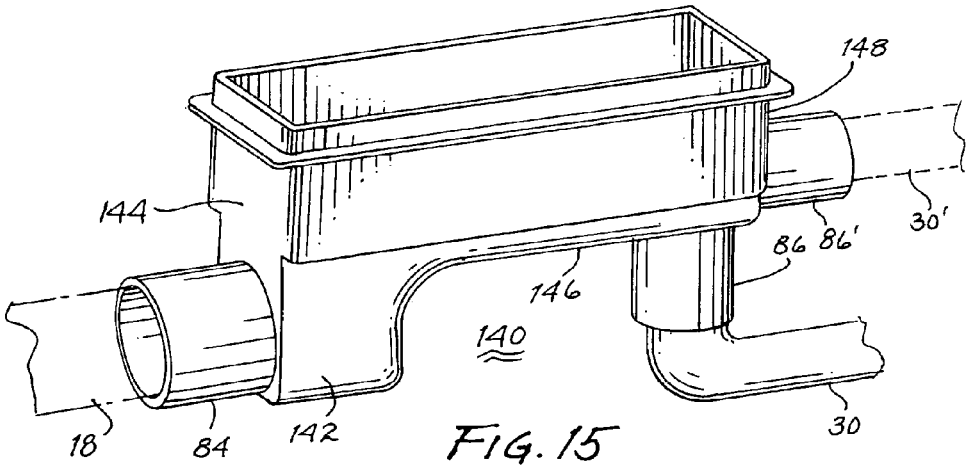
FIG. 15 illustrates a third variant of a preformed sump.
Figure 16:
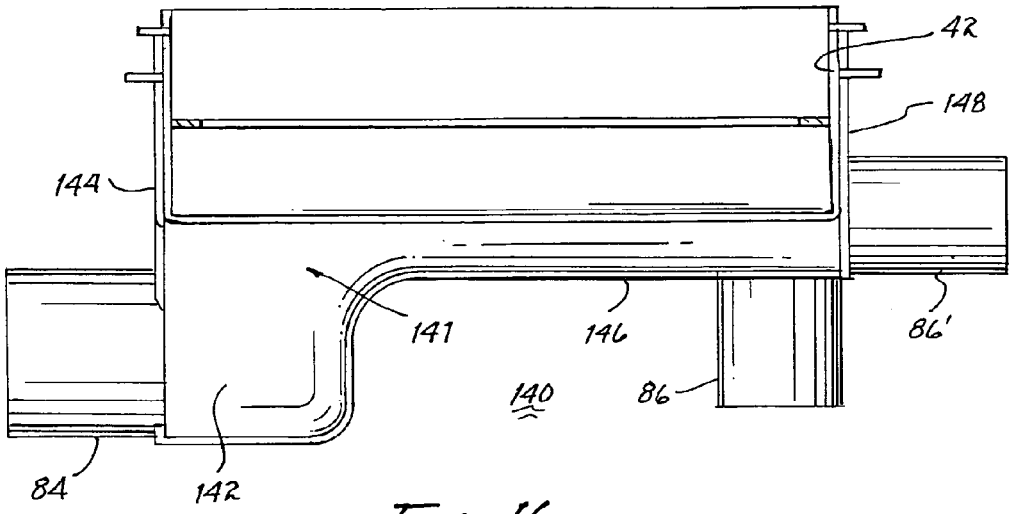
FIG. 16 illustrates a side view of the sump shown in FIG. 15.

FIGS. 15 and 16 illustrate a third variant of preformed sump 140, which sump includes a housing 141 supporting frame 42 as discussed above along with a grate, such as grate 52 discussed above. Sump 140 may have particular utility in prefabricated pools wherein the pool wall/bottom is relatively thin and in pools having a liner. Housing 141 includes a downwardly extending section 142 for supporting boss 84 extending horizontally from side wall 144. The boss is connected in a straight line to suction line 18. At the other end of the housing, boss 86 may extend downwardly from the bottom surface 146 and connected to bypass line 30. Alternatively, boss 86' may extend horizontally from side 148 of the housing. Boss 86' would be connected in line with bypass line 30'. By using horizontally extended bosses 84, 86', the required depth below the pool bottom is minimized. As is evident from inspection, the flow into boss 84 would be similar to the flow illustrated in FIG. 13 with regard to sump 130. As only one of bosses 86, 86' would be used in any given installation, the unused boss would be capped. It is to be understood that variant sump 140 could be made with only one of bosses 86, 86'.

Figure 17:
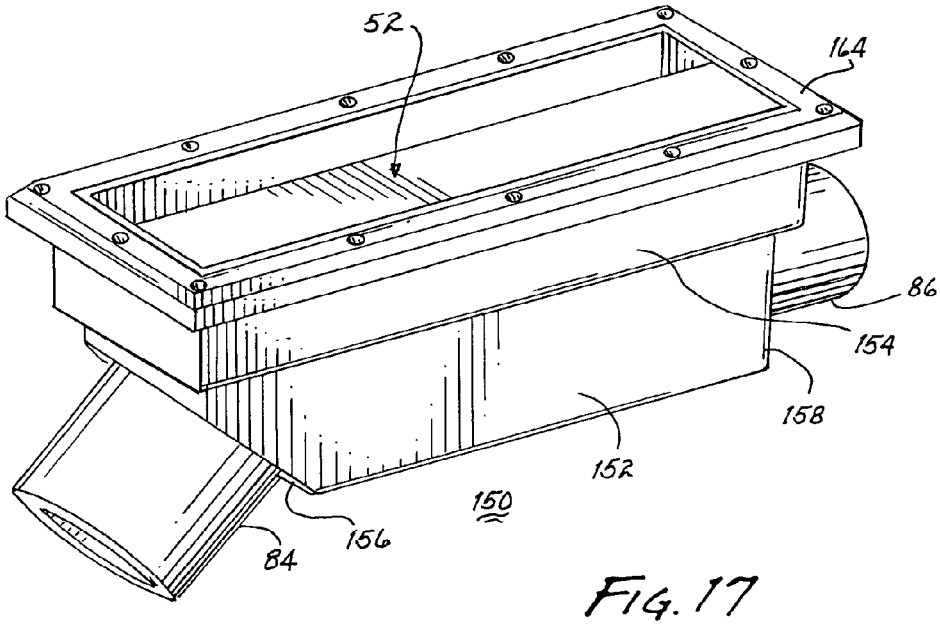
FIGS. 17, 18 and 19 illustrate the fourth variant of a preformed sump adapted for use with a swimming pool having a liner.
Figure 18:
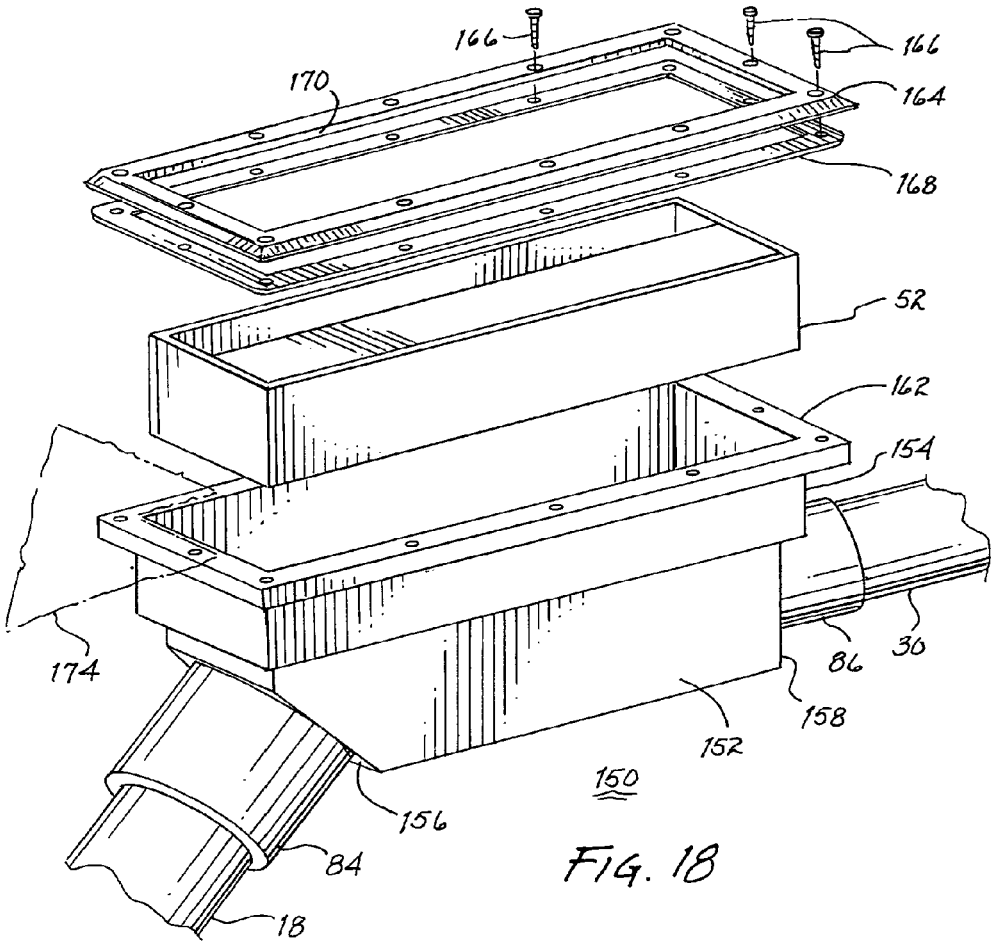
Figure 19:
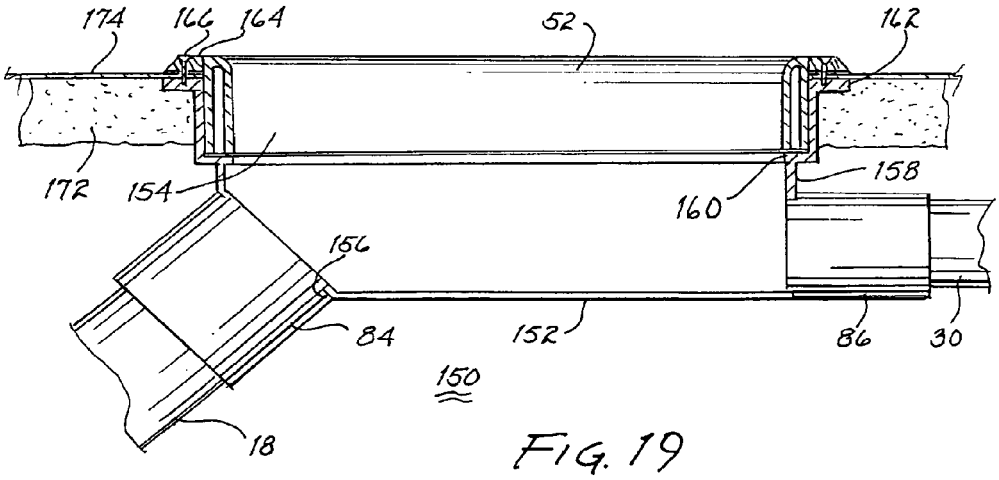
Figure 20:
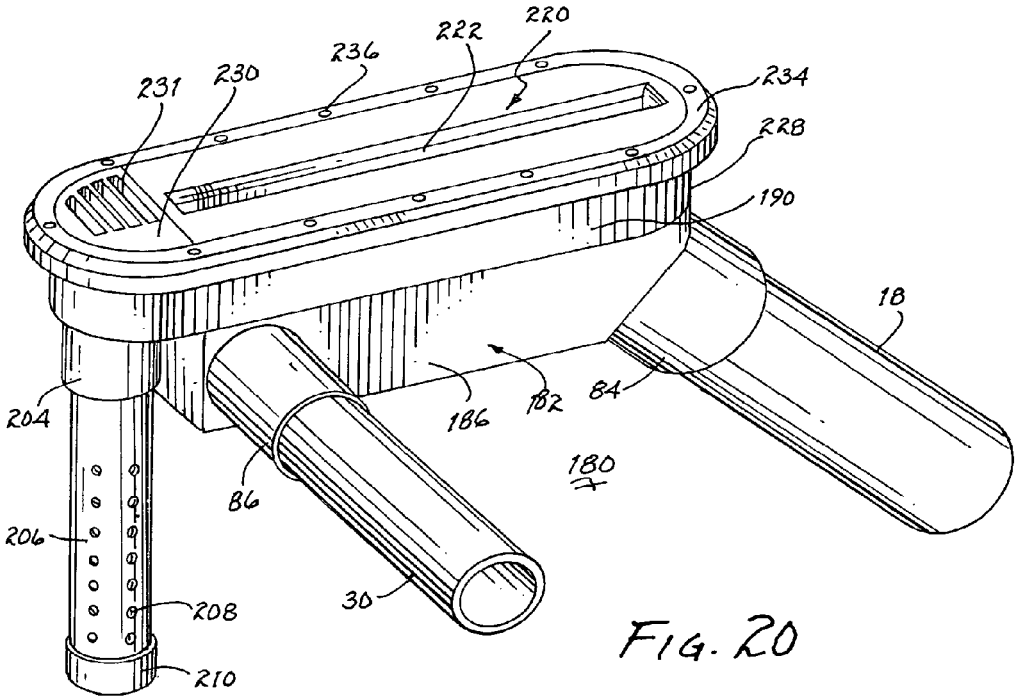
FIG. 20 illustrates a fifth variant of a preformed sump adapted for use in a swimming pool having a liner.

FIGS. 17, 18 and 19 illustrate a fourth variant of preformed sump 150 particularly adapted for use within a liner pool, whether above or below ground and wherein depth for the sump is a consideration. The sump includes a lower housing 152 and an upper housing 154 formed as a unitary structure. The lower housing supports boss 84 from a slanted side 156 in a manner similar to that of sump 130 shown in FIGS. 13 and 14. Boss 86 extends horizontally from side 158. As shown in FIGS. 18 and 19, boss 84 is in fluid communication with suction line 18 and boss 86 is in fluid communication with bypass 30. Upper housing 154 is attached to and extends from the top edges of lower housing 152 and defines an internally extending peripheral ledge 160. A relatively thick peripheral flange 162 extends about the upper edge of housing 154. Ledge 160, whether formed as a part of the junction between housing 152 and housing 154 or extending internally therefrom, serves the function of supporting a grate, like grate 52 described above. A rectangular ring 164 mates with flange 162 and a plurality of screws 166 interconnect the ring with the flange through corresponding apertures in the ring and holes in the flange, as is self-evident. A gasket 168 is lodged intermediate ring 164 and flange 162. The pool liner is clamped between flange 162 and ring 164 with gasket 168 serving to provide a leak free junction. Aperture 170 in ring 164 is sized to accommodate insertion and withdrawal of grate 52 therethrough.

Variant sump 150 is installed in a depression extending downwardly into the soil from the bottom of the hole defining the liner pool. During such installation, it would be connected to the requisite suction line 18 and bypass line 30. Pool liner 174 is thereafter installed in the hole for the pool and would cover flange 162 at the upper end of housing 154. Ring 164 would be placed in mating relationship to flange 162 and the ring would be secured to the flange by a plurality of screws 166. The use of gasket 168 therebetween provides a seal against water leakage intermediate the liner and flange 162. Thereafter, the liner material commensurate with the opening to upper housing 154 would be cut away and grate 52 would be inserted into housing 154. Screws, bolts or the like, may or may not be used to retain the grate in place. For an above ground liner pool, the sump would be supported in the conventional manner.

In some locations, the water table may be very close to ground elevation. When this is true, a swimming pool, when empty, may "float" and actually rise. Obviously, when such movement of the pool occurs the interconnected structure is usually destroyed or at least severely damaged. For this reason, many municipalities require the pools to have a hydrostatic valve to permit ground water inflow to the pool when the level of the water in the pool is below the ground water level.

Referring to FIGS. 20, 21, 22 and 23, there is shown a fifth variant of preformed sump 180 particularly adapted for use in a pool defined by a plastic liner lining a depression in the ground. Elements common with previously described sumps will be identified by common reference numerals. Sump 180 is similar in certain respects with sump 150 shown in FIGS. 17, 18 and 19 as both are particularly configured for use with above or below ground liner type pools. With such pools, it is usually preferable to minimize the depth to which the sump and attendant plumbing extends below the bottom of the pool.

Sump 180 includes a housing 182 having a sloping side 184 supporting boss 84. Suction line 18 is attached to and extends from this boss. Side 186 of the housing supports boss 86 and bypass line 30 extends therefrom. A second housing 190 extends above housing 182 and is laterally expanded to define ledges 192, 194, 196 and 198. End 200 of housing 190 is generally semicircular in planform and includes a bottom surface 202. A hollow boss 204 extends downwardly from surface 202 and supports a pipe 206 having a plurality of apertures 208 therein with the lower end being capped by a cap 210. A conventional hydrostatic valve 212 is disposed in proximity to boss 204. A wall 214 extends from surface 202 upwardly to segregate the interior of end 200 from the remaining space in housing 190 (and housing 182). The top edge of housing 190 includes a peripheral lip 216 extending outwardly. A grate 220 includes a slot 222 similar to slot 54 discussed above except that it may be located along the center line of the grate, as illustrated. The grate is configured to have a flat end 224 for positioning adjacent wall 214 and a semicircular end 226 to conform with the interior of semicircular end 228 of housing 190. The grate is supported upon ledges 192, 194, 196 and 198. A secondary grate 230 is semicircular in planform and includes a plurality of slots 231 disposed therein. This grate is supported within end 200 and adjacent wall 214.

When the water table beneath the pool rises a sufficient amount, water will flow into pipe 206 through apertures 208. The water flowing into end 200 of housing 190 vents into the pool through slots 231 of secondary grate 230. Such flow is precluded by hydrostatic valve 212 unless the pressure acting upon the valve by the water in the pool is less than the pressure of the ground water acting upon the valve. In the later event, ground water will flow through slots 231 into the pool and fill the pool commensurate with the level of the ground water. Thereby, flotation of the pool is avoided. It is self-evident that when the pool is filled with water, no ground water will flow through hydrostatic valve 212 and the pool will not become contaminated by the ground water.

It is to be noted that the assembly relating to the hydrostatic valve is physically separated from the sump assembly and its operation. Access to the hydrostatic valve is possible without disturbing the components of the sump. Moreover, it is hydraulicly isolated from the sump.

Figure 21:
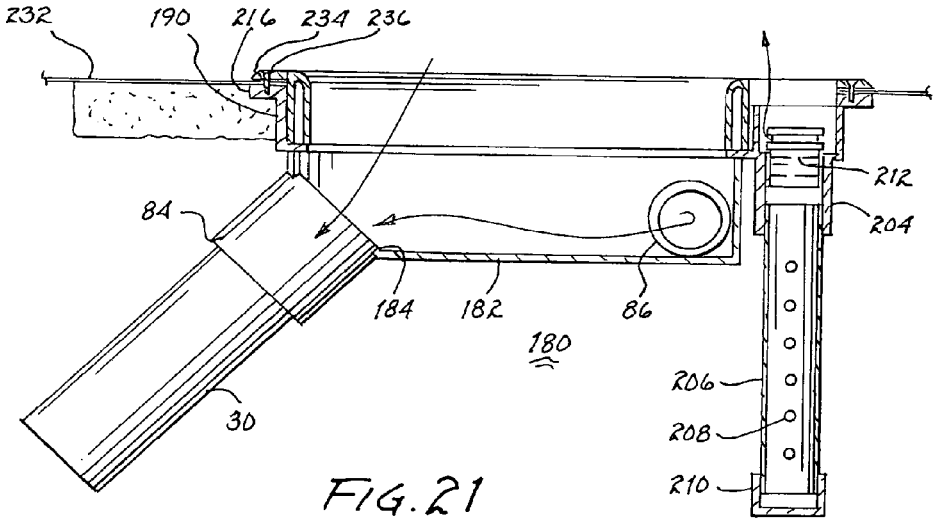
FIG. 21 illustrates a side view of the sump shown in FIG. 20.
Figure 22:
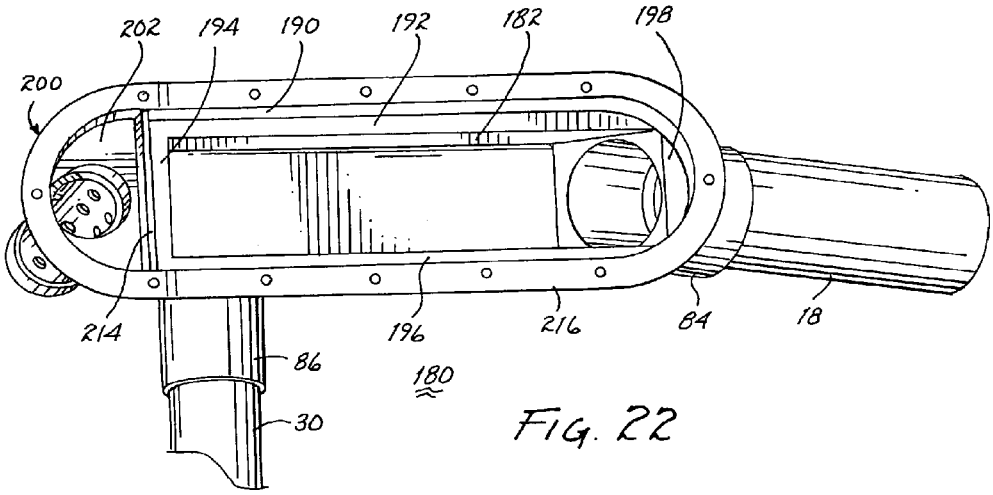
FIG. 22 illustrates a top view of the sump shown in FIGS. 20 and 21.
Figure 23:
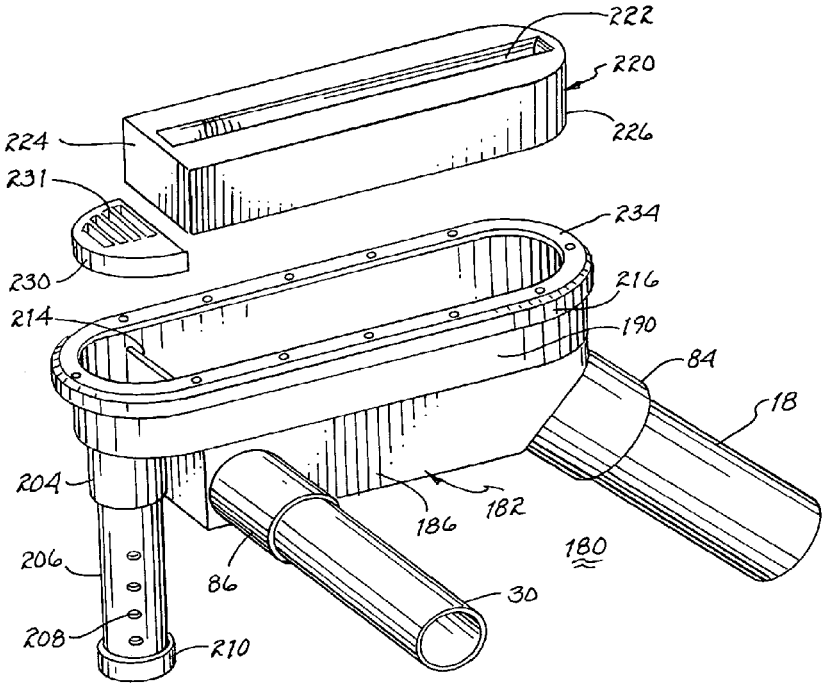
FIG. 23 is a partial exploded view of the sump shown in FIGS. 20, 21 and 22.

As particularly shown in FIG. 21, sump 180 is adapted for installation in a liner pool, whether above or below ground. Such installation will be briefly described below. After the soil for the swimming pool has been removed, a further depression is created at essentially the low point and sump 180 is placed therein. Necessarily, suction line 18 and bypass line 30 are attached to the sump and pipe 206 extends downwardly for a distance into the soil. After installation of the sump at the appropriate location adjacent the bottom of the pool, a vinyl liner 232 is installed in the normal manner and will cover the variant sump. A collar 234 generally commensurate in width and shape with lip 216 is placed upon the lip and secured to the lip by a plurality of screws 236. Thereafter, the material of the liner interior of the collar is cut away. Grate 220 and secondary grate 230 are now installed in housing 190.

FIGS. 24, 25, 26 and 27 illustrate a sump 240 very similar to sump 180 described above except that sump 240 is intended for use in a conventional pool formed primarily of cementitious material, but could be installed in a pool made of fiberglass. Accordingly, the description below will be primarily directed to the differences between sumps 180 and 240; common reference numerals will be used for common elements.

Sump 240 includes a lower housing 242 having an angled surface 244 for supporting boss 84 and suction line 18 attached thereto. End 246 of the lower housing includes a laterally expanded section one side of which supports boss 86 and bypass line 30 attached thereto. An upper housing 250 of generally oval shape, as illustrated, has a lateral width essentially coincident with expanded section 248 of the lower housing. Ledges 252, 254 and 256 interconnect the upper housing with the narrowed section of the lower housing, as illustrated. End 258 of the upper housing is generally semicircular and extends beyond end 246 of the lower housing and includes a panel 260 for supporting hollow boss 204 supporting pipe 206 extending therefrom and hydrostatic valve 212 associated with the boss. A circumferential ledge 262 extends laterally from about upper housing 250.

Figure 24:
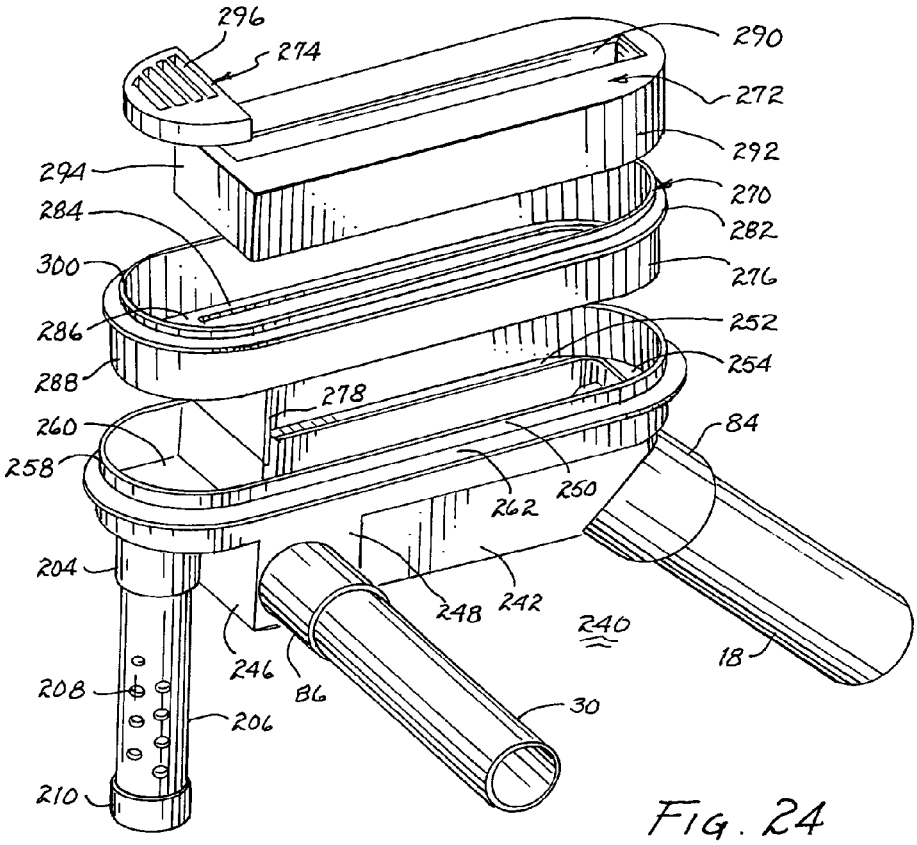
FIG. 24 is a further exploded view of a sump adapted for use in a concrete pool.
Figure 25:
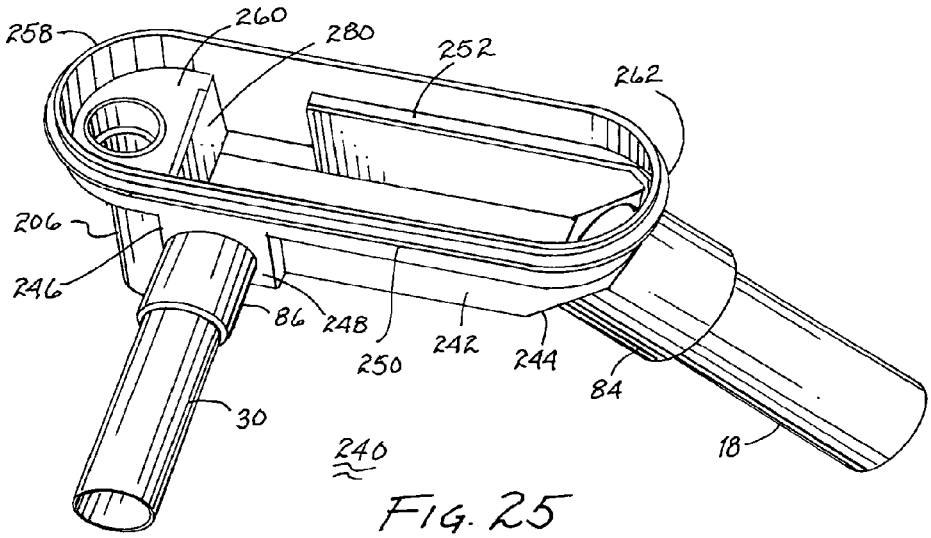
FIG. 25 is an isometric view of the third variant shown in FIG. 24.

Referring primarily to FIG. 24, frame 270, grate 272 and secondary grate 274 will be discussed. The primary function of frame 270 is that of positioning the upper surface of grate 272 and secondary grate 274 in a plane commensurate with the bottom of a pool. Accordingly, frame 270 is vertically positionable and to some extent cantable as necessary to achieve alignment of the grate with the pool bottom. Frame 270 includes a skirt 276 having an exterior dimension essentially coincident with the interior vertical surface of upper housing 250. At the lower most position of the frame, it may rest upon ledges 252, 254 and 256. A panel 278 extends downwardly from the frame at a location to place it essentially adjacent wall 280 (see FIG. 25). Furthermore, the width of panel 278 is essentially coincident with the distance between the sides of lower housing 242 at expanded section 248 and the width of the walls of upper housing 250. Thereby, panel 278 essentially segregates the space defined by end 258 from the remaining interior surface of the sump irrespective of the vertical position of frame 270 relative to the sump 240. A peripheral ledge 282 extends about frame 270 for mechanical engagement with setting material upon installation in a pool. An internally extending ledge 284 is coincident with the bottom edge of frame 270 and includes a cross member 286 extending across the frame; it delineates the semicircular end 288 of the frame to leave the space between this section and the curved wall of the skirt with an open bottom.

Grate 272 includes a slot 290 extending generally along the center line and dimensioned as discussed above. Skirt 292 of the grate is dimensioned to have a close fit within frame 270 up to semicircular end 288 and wall 294 of the grate terminates essentially coincident with cross member 286. Thereby, wall 294 in combination with the interior surface of end 288 forms the equivalent of a semi-cylindrical space. Secondary grate 274 covers this semi-cylindrical space but provides communication from therein through slots 296. Bosses disposed within frame 270 may be used to support the secondary grate. Alternatively, legs may extend downwardly from the secondary grate to bear against the ledge at the lower end of the frame and thereby support the secondary grate.

The installation of further variant sump 240 will be described with primary reference to FIGS. 26 and 27. During construction of the pool from cementitious material 38, variant sump 240 is lodged therein spaced apart from expected finished bottom 14. Ledge 262 surrounding upper housing 250 provides a mechanical lock with the cementitious material and movement of the sump is prohibited. It may be noted that suction line 18, bypass line 30 and pipe 206 are secured to their respective bosses prior to formation of the cementitious material about the sump. Preferably, the cementitious material extends upwardly at an angle away from ledge 262. After the cementitious material has cured, frame 270 is inserted within the upper housing at a height and at a cant such that its top edge 300 is essentially coincident with finished bottom 14 of the pool. Setting material 106 and the coating 48 are laid around the frame to encase and mechanically lock ledge 282 of the frame with the setting material. Thereafter, grate 272 and secondary grate 274 are inserted within the frame.

Figure 26:
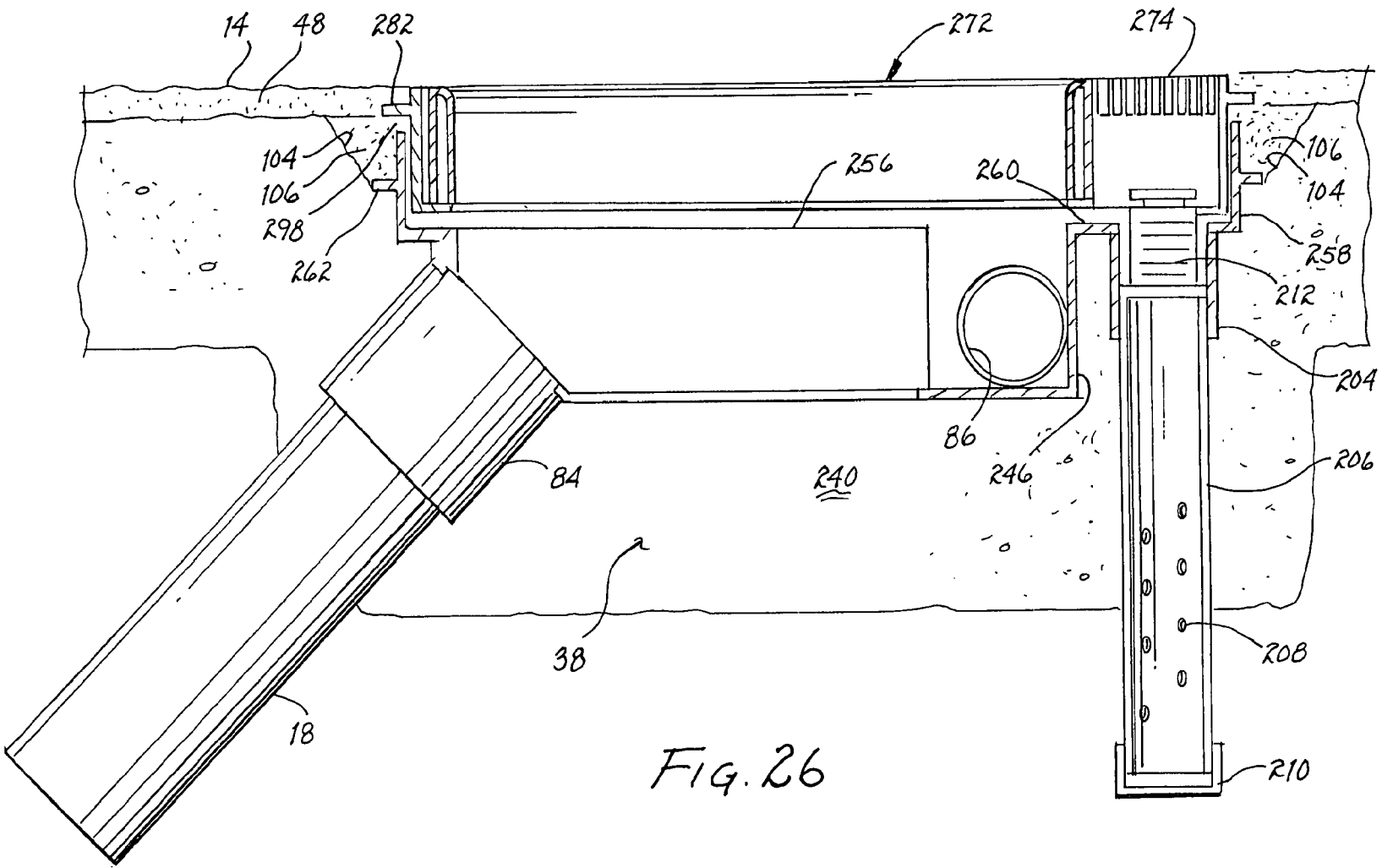
FIGS. 26 and 27 illustrate mounting of the components of the sump shown in FIGS. 24 and 25 to accommodate different finish elevations of a concrete swimming pool.
Figure 27:
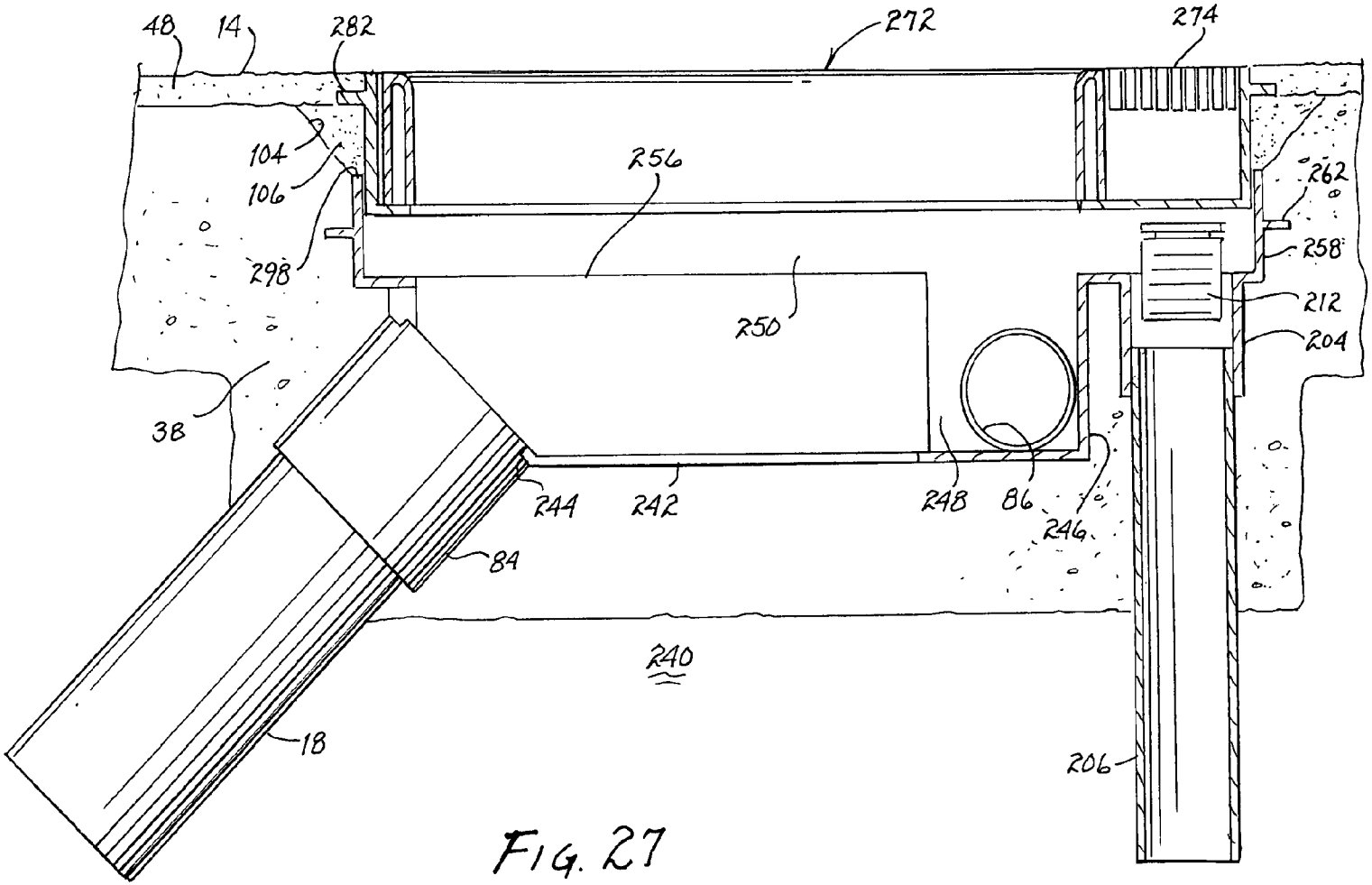

As may be noted from FIG. 26, sump 240 is closer to bottom 14 than is sump 240 shown in FIG. 27. This difference in height is readily accommodated by raising or lowering frame 270 with respect to the upper housing and such vertical movement can be carried out to the extent of the depth of skirt 276; moreover, as is true with the frames discussed and to be discussed, the frame can be somewhat canted to accommodate alignment with the bottom of the pool. Operation of sump 240 is essentially equivalent to that described above with respect to sump 180 and need not be repeated herein.

Figure 28:
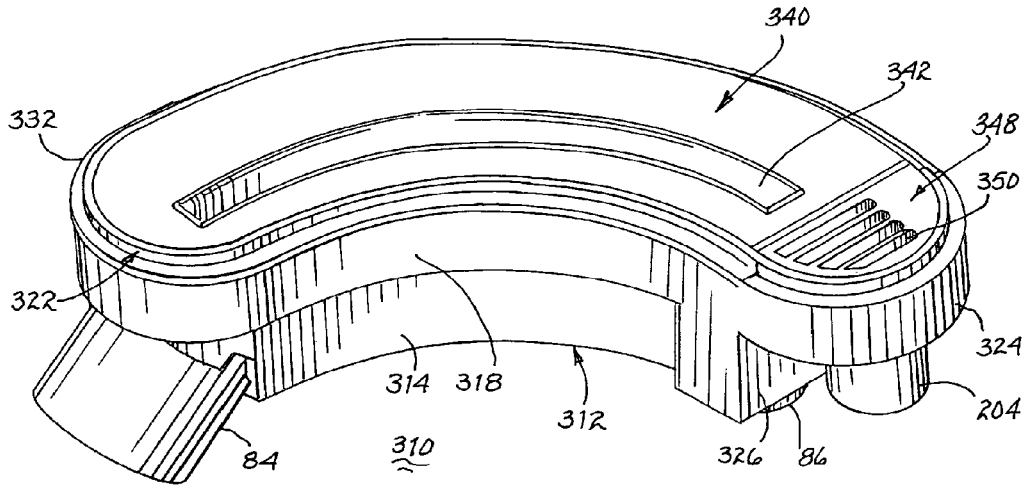
FIG. 28 illustrates a sixth variant of a preformed sump.
Figure 29:
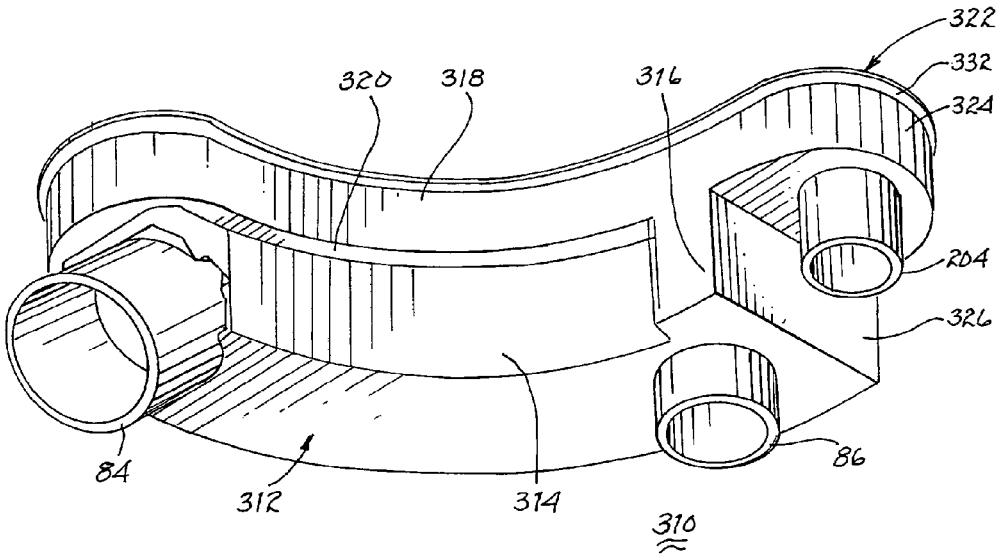
FIG. 29 is a bottom view of the sump shown in FIG. 28.
Figure 30:
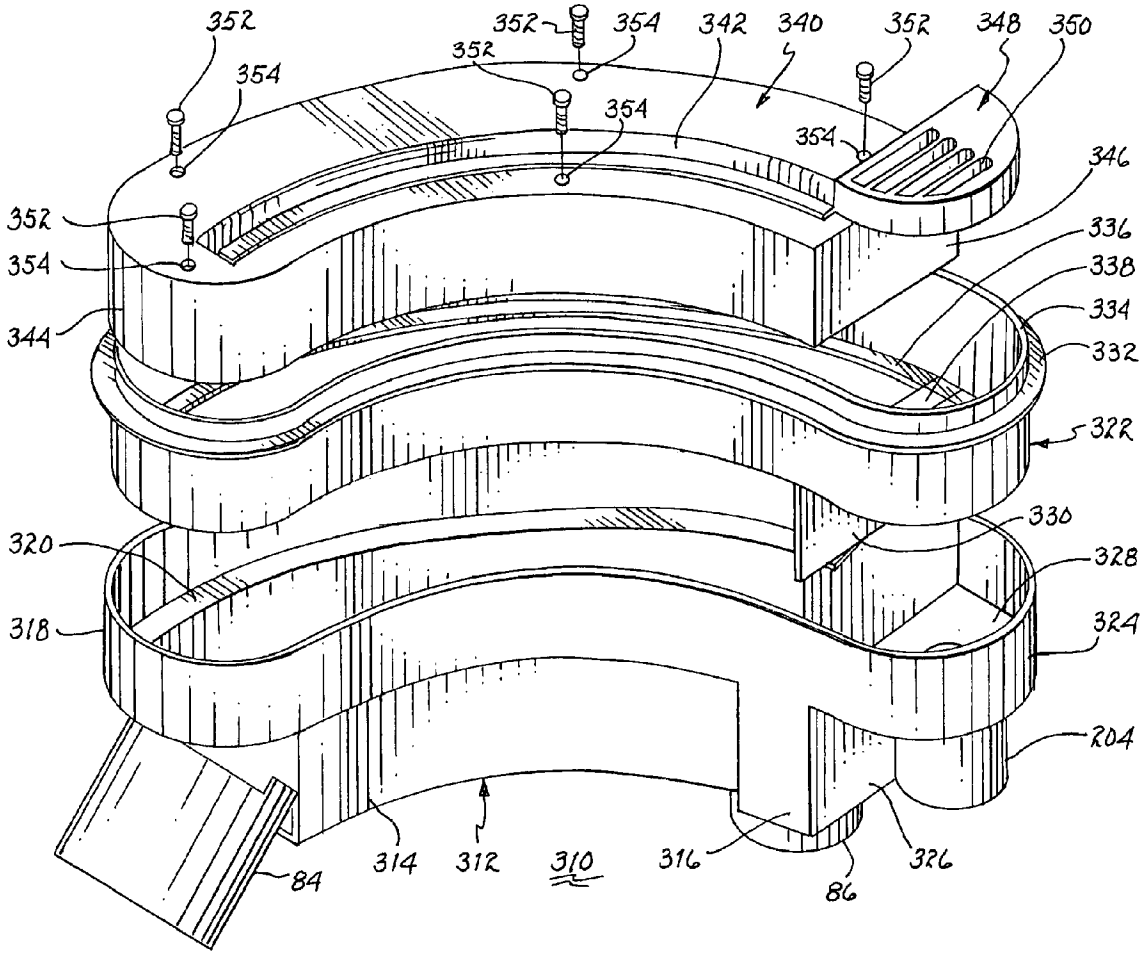
FIG. 30 is an exploded view of the sump shown in FIGS. 28 and 29.

A sixth variant sump 310 is illustrated in FIGS. 28, 29 and 30. This sump is very similar to sump 240 with two major differences. First, this sump is curved or arcuate. Second, bypass line 30 enters the sump at the bottom rather than along a side. Because of the similarity of the components of sump 310 with sump 240, and the fact that installation is equivalent within the cementitious material of a pool, the description below will be relatively cursory.

An arced housing 312 includes a lower housing 314 having an expanded section 316 and interconnected with an upper housing 318. A ledge 320 interconnects the lower housing with the upper housing and serves as a support for frame 322 when the frame is at its lower most point relative to housing 312. Lower housing 314 supports boss 84 from an angled side and supports boss 86 from the bottom surface at the end of the housing opposite from boss 84. End 324 of upper housing 318 extends beyond wall 326 of lower housing 314 and defines a semicircular cavity having a floor or panel 328. Boss 204 is supported by and extends from panel 328 for interconnection with the hydrostatic valve assembly. Frame 322 includes a panel 330 which is inserted within expanded section 316 adjacent wall 326 upon mating of the frame with the housing 312 to form a relatively closed compartment within end 324 irrespective of the vertical position of the frame relative to the housing. A ledge 332 extends about frame 322 to mechanically secure the frame relative to the surrounding cementitious material (or setting material) of the pool upon installation. As noted with respect to sump 240, the height of the frame relative to the housing is a function of the location of the housing relative to the finished bottom of the pool in order to locate top edge 334 of the frame essentially coincident with the surface of the bottom of the pool. Frame 322 includes an internal ledge 336 and a cross member 338 for supporting grate 340 to be placed within the frame; it also provides strength to the frame. Grate 340 includes a curved or arcuate slot 342 extending for essentially the full arcuate length of the grate. Skirt 344 of the grate is dimensioned to mate with the interior surface of the frame and is of a depth commensurate with the distance from top edge 334 of the frame to ledge 336 in order to place the top surface of the grate essentially in the plane defined by top edge 334. The grate includes a wall 346 that rests upon cross member 338 in the frame and defines a semi cylindrical cavity within the corresponding end of the frame. Grate 340 may be secured to frame 322 by screws 352 penetrating holes 354 and into engagement with the corresponding parts of ledge 336, cross member 338; other means for attaching the grate may be used. A secondary grate 348 is disposed within the frame adjacent wall 346 of grate 340 and the interior wall of the frame. One or more slots 350 are formed in the secondary grate to provide fluid communication from boss 204, through end 324 of housing 312, the corresponding end of frame 322 and through the slots. Thereby, any ground water flowing through the hydrostatic valve associated with boss 204 will flow directly into the pool as panel 330 extending from the frame essentially precludes flow of such water into housing 312 and the conduits associated therewith. If the hydrostatic valve is not needed, boss 204 can be capped.

Installation of sump 310 in the cementitious material forming the pool is equivalent to the installation procedure discussed above with respect to sump 240.

Referring jointly to FIGS. 31, 32, 33 and 34 there is shown a cylindrical sump 360 embodying the gist of the present invention. As there are certain elements of this sump which are common with elements in the previously described sumps, common reference numerals will be used for such elements. A cylindrical housing 362 supports boss 84 for discharging water into radially expanded suction line 18 and suction line 20. Bypass line 30 is connected via boss 86 to the housing. It is to be understood that housing 362, boss 86, boss 84 and necked down suction line 18 can be manufactured or assembled as a single unit for use in the field. A pipe 206, having apertures 208 for admitting ground water, extends from boss 204 located at the center bottom of housing 362; this pipe can be made as part of the housing also. An inflow of water, as represented by arrow 364 swirls about grate 366 and flows into circular slot 368. Slots 370 in cap 372 accommodate outflow of ground water into the pool.

Cylindrical sump 360 is intended for use with a liner pool. Hence, a representatively illustrated sheet 374 of vinyl is illustrated. It is to be understood that cylindrical sump 360, along with the attendant water lines, would be located in the dirt beneath the vinyl sheet if the liner pool is an in-ground pool.

Figure 31:
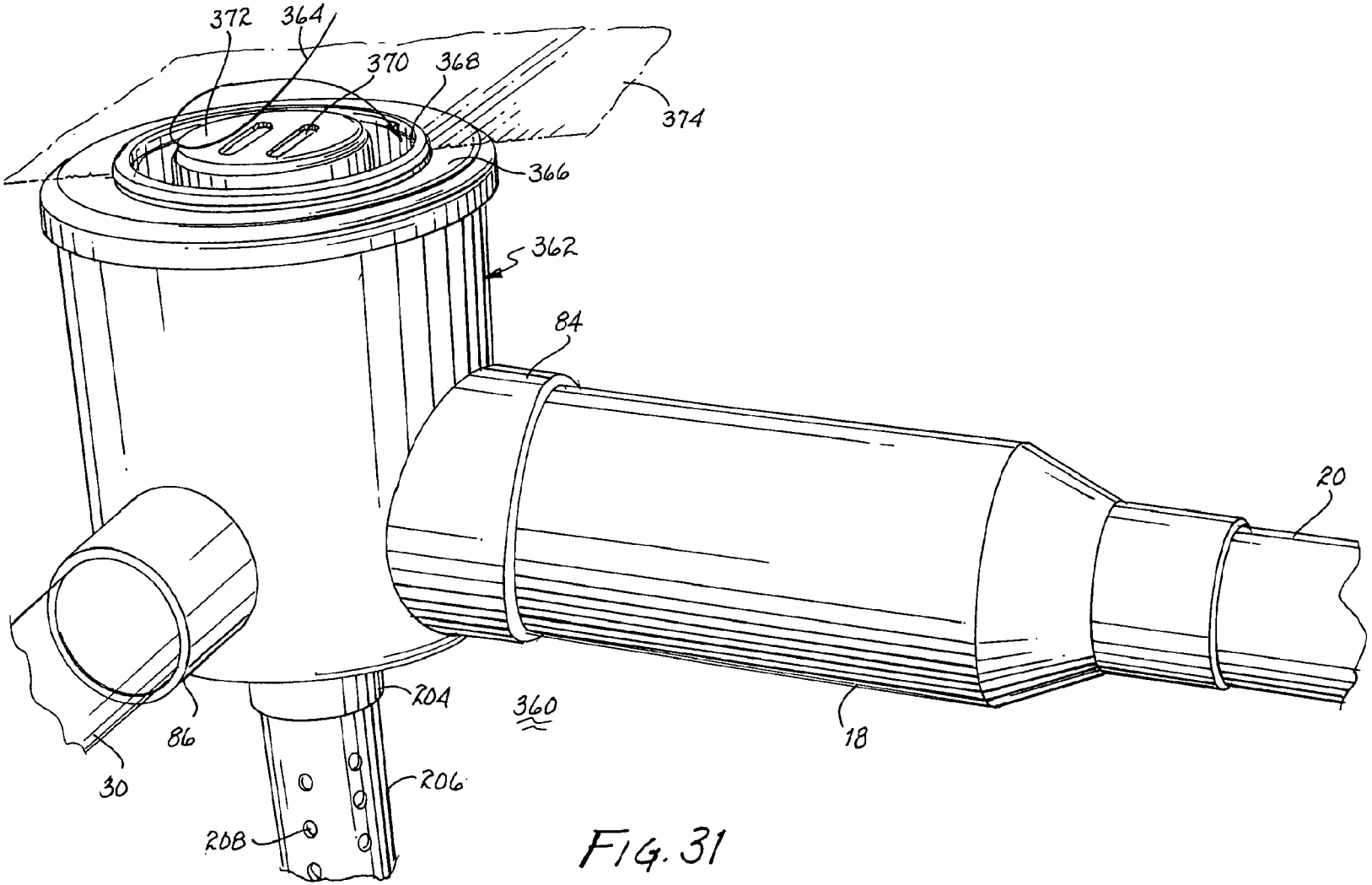
FIG. 31 illustrates a preformed cylindrical variant of the sump.
Figure 32:
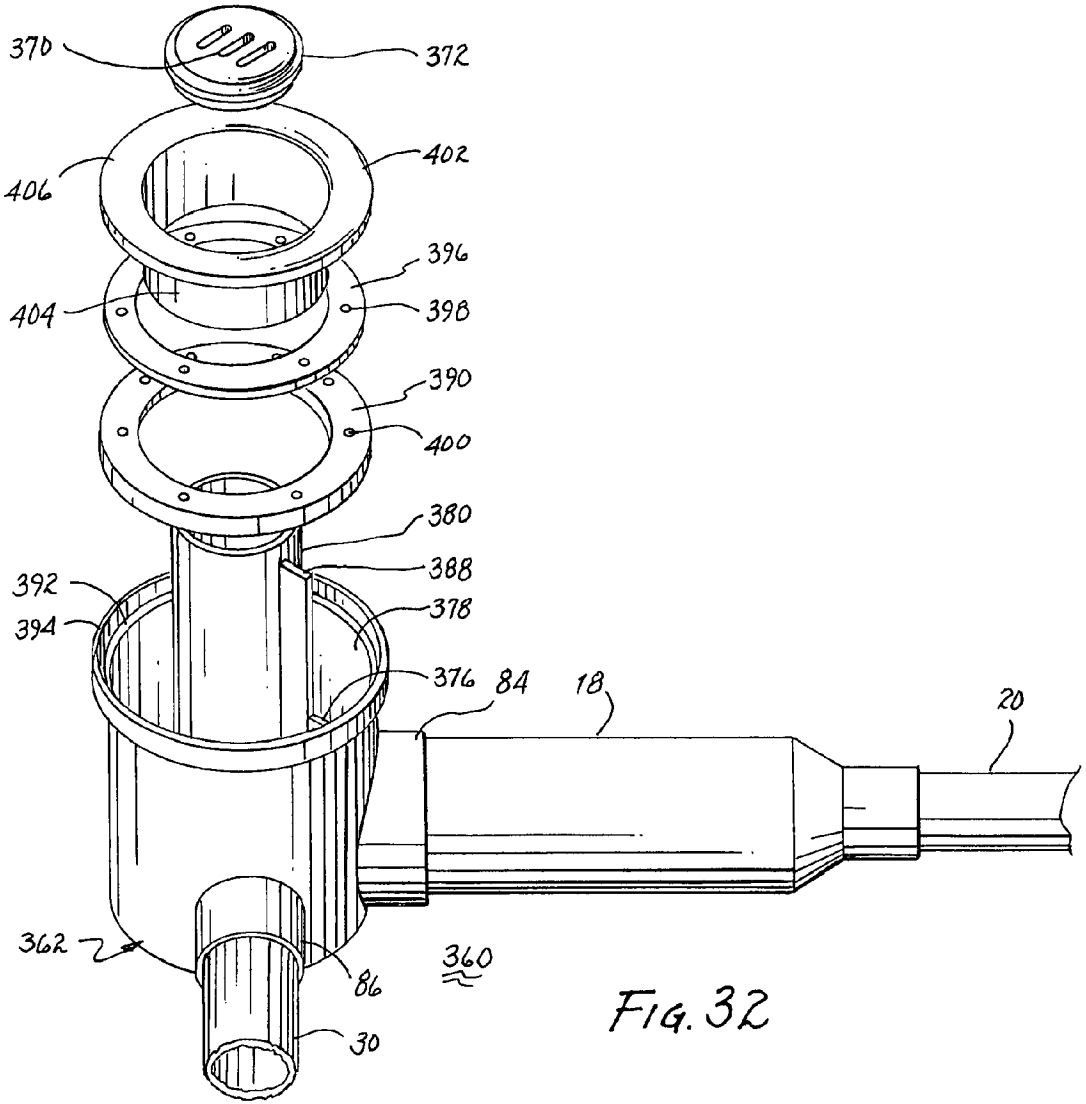
FIG. 32 is an exploded view of the sump shown in FIG. 31.
Figure 33:
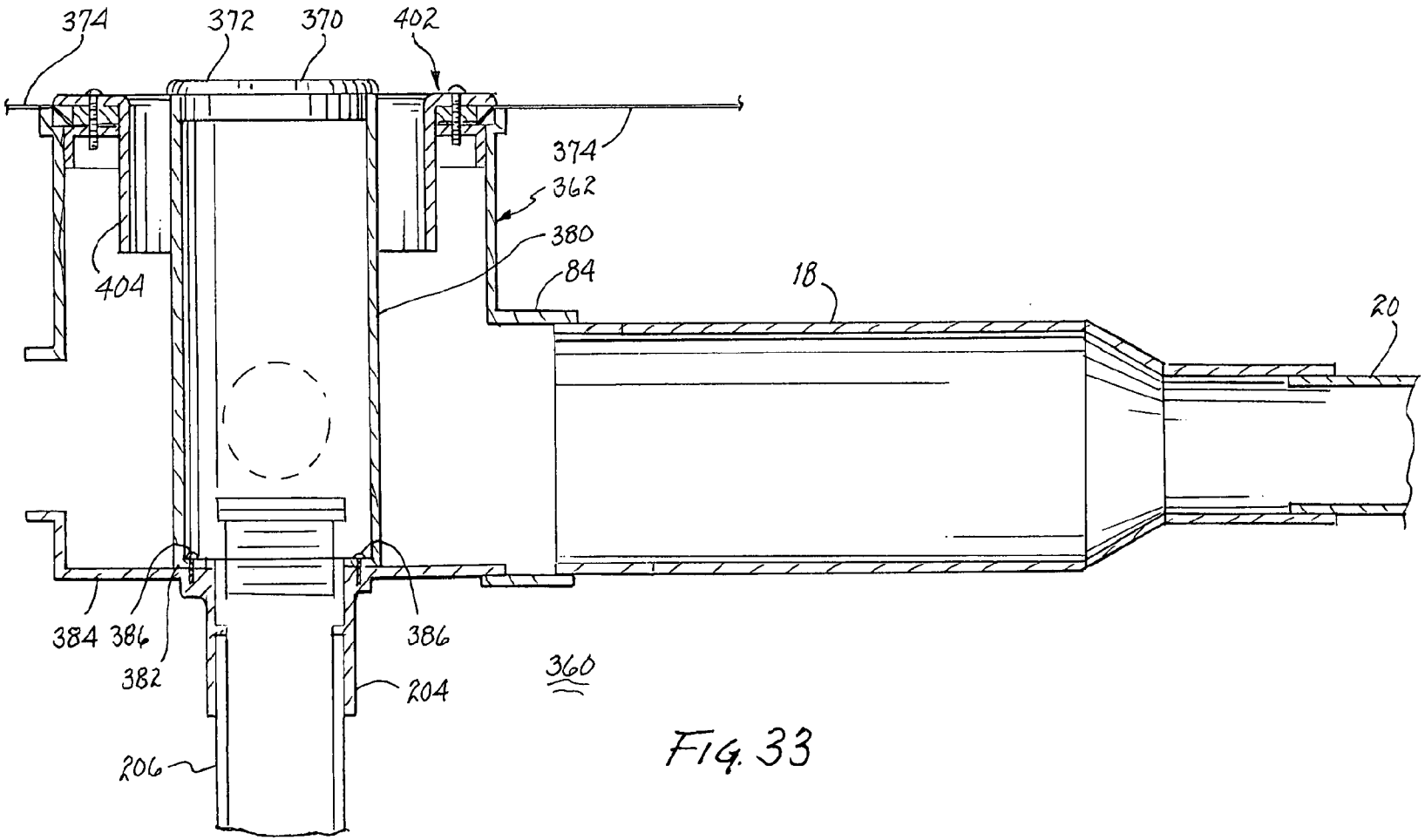
FIG. 33 is a partial cross sectional view of the sump shown in FIGS. 31 and 32, and FIGS. 33A and 33B illustrate attachment of a pool liner to the sump.
Figure 33A:
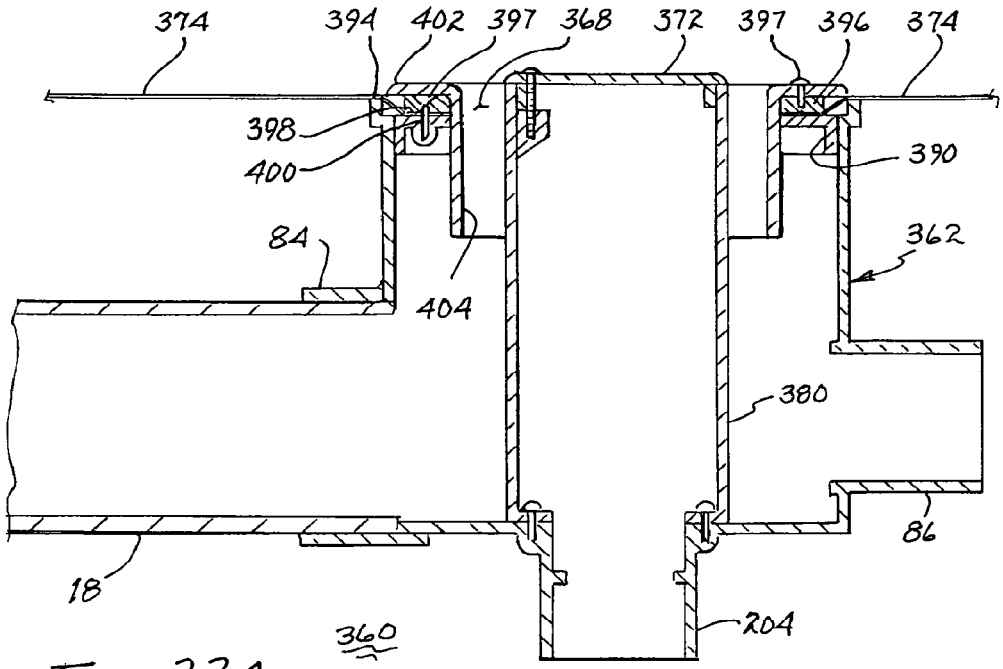
Figure 33B:
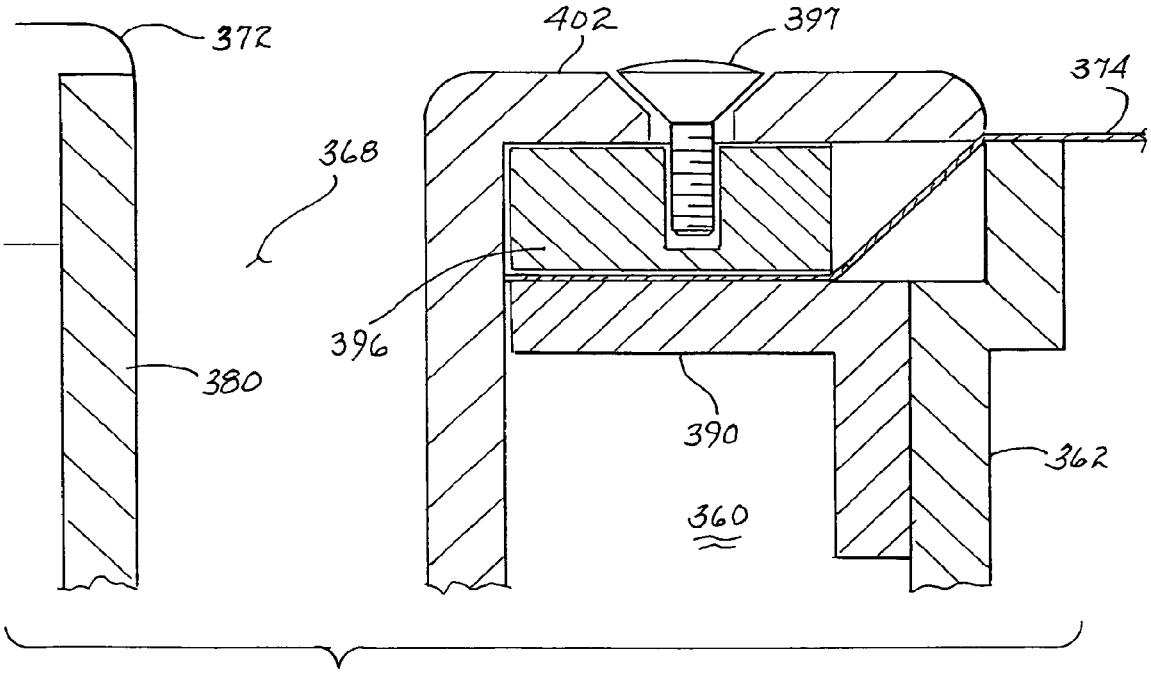
Figure 34:
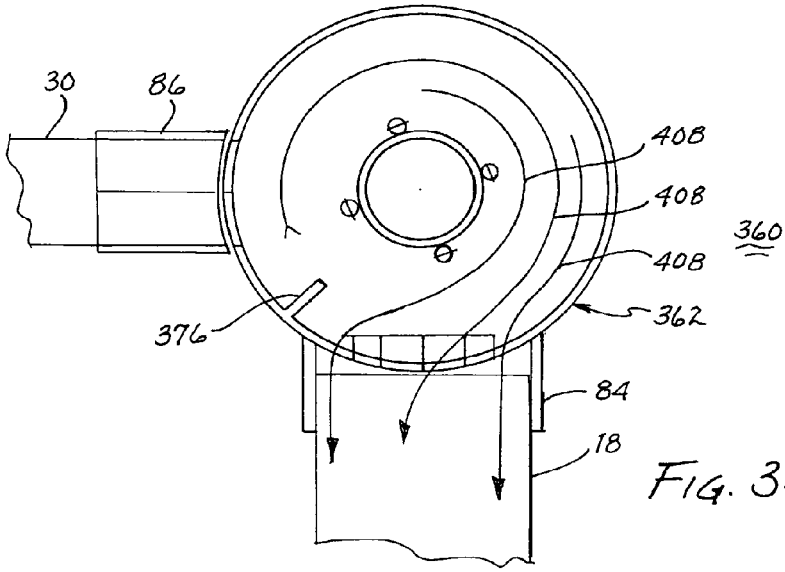
FIG. 34 illustrates the waterflow within the sump shown in FIGS. 31, 32 and 33.

The interior construction of cylindrical sump 360 will be described with reference primarily to FIGS. 32, 33 and 34. A vertical wall 376 extends radially inwardly from interior surface 378 of cylindrical housing 362. A cylinder 380 includes an interior circular flange 382 for attaching the cylinder to bottom 384 of the housing with screws 386 or the like. A vertical radially outwardly extending wall 388 extends from cylinder 380 into contacting engagement with the interior edge of wall 376. Thereby, circular flow about cylinder 380 is essentially precluded. It may be noted that the location of walls 376, 388 are intermediate bosses 84, 86 and their associated openings in the housing. Cap 372, and its associated slots 370, is in sealing engagement with the top of cylinder 380. A ring 390 rests upon circular ledge 392 disposed interior of housing 362 and below top edge 394 thereof. Alternatively, it may be secured to the interior surface of housing 362, as shown in FIGS. 33A and 33B. A further ring 396 is secured to ring 390 by screws 397 or the like penetrably engaging holes 398 in ring 396 and threadedly engaging holes 400 in ring 390. It is to be understood that vinyl sheet 374 (see FIGS. 31, 33A and 33B) is disposed intermediate these two rings and that the vinyl sheet is clamped in place by the rings. It may be noted that the elements of the clamps are interior to the external surface of housing 362. To ensure a sealed engagement with the liner, an annular gasket may be used in the conventional manner. After clamping, the portion of vinyl sheet interior of the rings is cut away.

A shroud 402 includes a circular skirt 404 depending from a ring element 406. Upon installation of shroud 402, the skirt defines an annular space between it and the exterior cylindrical surface of cylinder 380. The shroud may be secured in place by screws 397 as shown on the right in FIGS. 33A and 33B. Thereby, slot 368 illustrated in FIGS. 31, 33A and 33B is formed. As particularly shown in FIGS. 31 and 34, the suction present within boss 84 draws water from within housing 362. The flow path of this water is downwardly through slot 368 with most of the water being drawn through the slot counterclockwise from wall 376, as depicted by arrow 364 in FIG. 31 and arrows 408 shown in FIG. 34. Thereby, the flow rate demanded by suction pump 26 (see FIG. 1) is fully satisfied and little, if any, water will be drawn through boss 86 from bypass line 30 to satisfy the waterflow demand present at the outlet to boss 84. However, should slot 368 be covered to a greater or lesser degree, sufficient low pressure would exist at the inlet to boss 86 to cause water to flow clockwise within housing 362 to satisfy the demand at the inlet to boss 84. As noted previously, in the event the liner pool is empty and the level of ground water approaches that of the bottom of the pool, the hydrostatic valve attendant boss 204 will open and ground water will flow through cylinder 380 and slots 370 in cap 372 and into the pool to prevent the pool from floating.

FIGS. 35, 36, 37, 38 and 39 illustrate a variant cylindrical sump 410. Elements common with previously described embodiments will be referenced with the same reference numerals. This cylindrical sump is also intended to be used with a liner pool, as indicated by vinyl sheet 374 in FIG. 38. Housing 412 includes a bottom 414 supporting an elbow 416 to which boss 84 is attached and an elbow 418 to which boss 86 is attached. Boss 204, attendant pipe 206 and a hydrostatic valve, also extends from bottom 414. Aperture 420 in bottom 414 is in fluid communication with elbow 416. Aperture 422 is in fluid communication with boss 204. Aperture 423 is in fluid communication with elbow 418. A vertically extending shroud 424 includes a cylindrical section 426 to define an annular space 428 intermediate the cylindrical section and interior surface 430 of housing 412. A further section 432 is coincident with a part of the edge of aperture 420. A still further section 434 is coincident with a part of the edge of aperture 422. A wall 436 extends from the junction of sections 432, 434 to surface 430 of housing 412. Thereby, any flow within housing 412 between aperture 420 and aperture 422 must be through annular space 428. The upper edge of housing 412 includes an radially extending circular lip 438 having a plurality of holes 440 spaced there along. A ring 442 is generally coincident with lip 438 and includes a plurality of holes 444. This ring is used to clamp the sheet of vinyl against lip 438; screws 446 may be used to penetrably engage holes 444 and threadedly engage holes 440 in the lip. An annular gasket may be used to ensure a sealed junction with the sheet of vinyl. As noted above, the vinyl sheet interior of ring 442 is cutaway.

Figure 35:
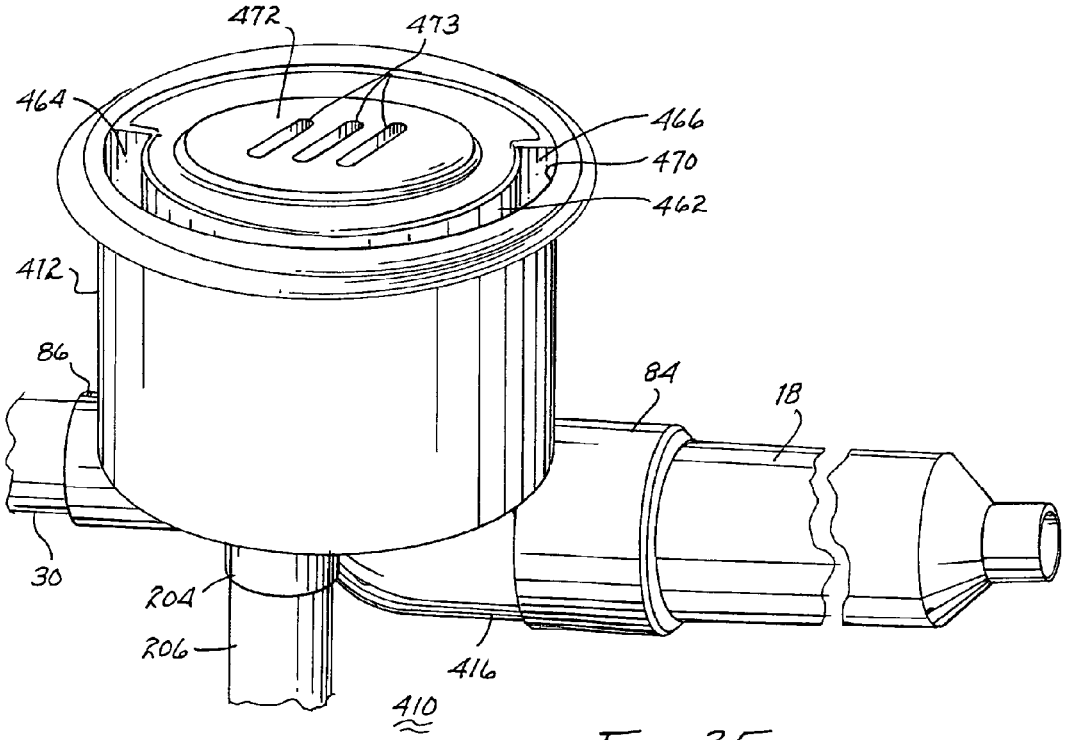
FIG. 35 illustrates a first variant of a preformed cylindrical sump adapted for use in a swimming pool having a liner.
Figure 36:
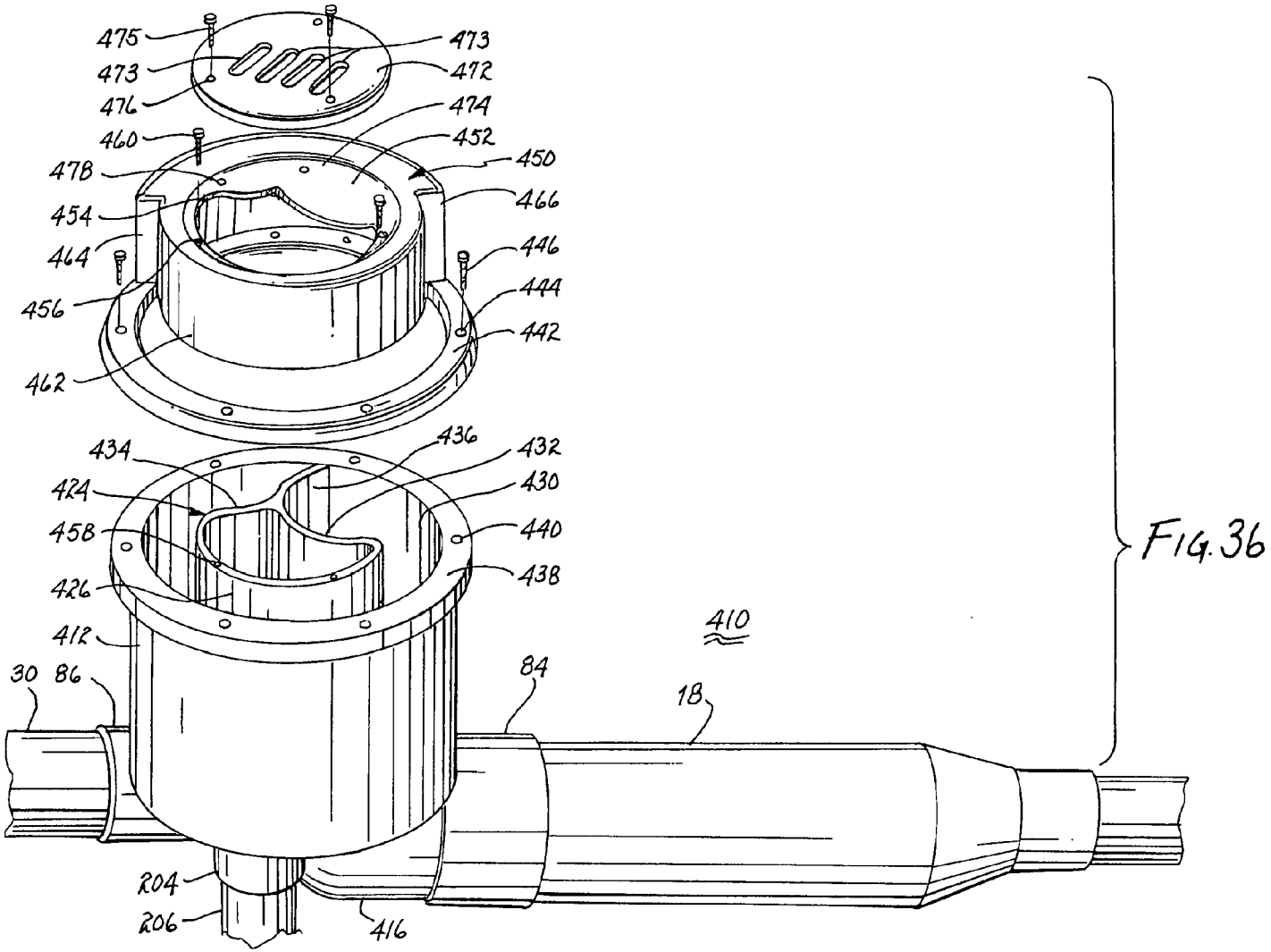
FIG. 36 is an exploded view of the sump shown in FIG. 35.

A further shroud 450 includes a recessed apertured plate 452 having an aperture 454 generally coincident with the interior edges of sections 426, 432 and 434 of shroud 424. A plurality of holes 456 in plate 452 are coincident with each of a plurality of holes 458 formed in the top edge of shroud 424 to secure shroud 450 with shroud 424 by screws 460 penetrating the respective pairs of holes. Shroud 450 includes a first section of a cylindrical skirt 462 having a radius to place it radially outwardly of section 426 of shroud 424. Vertical walls 464, 466 are disposed at the terminal ends of skirt 462. Slot 470, as primarily depicted in FIG. 35, is formed by skirt 462, walls 464 and 466 and interior surface 430 of housing 412. Thus, slot 470 is formed by a plurality of separate but joined elements.

A cap 472 includes a plurality of slots 473. This cap is placed adjacent to plate 452 in the depression formed by downwardly extending cylindrical wall 474. The cap may be retained in place by screws 475 penetrably engaging holes 476 and threadedly engaging holes 477 in plate 452. In the event the hydrostatic valve associated with boss 204 is opened due to an empty pool and a rising ground water level, the water will flow upwardly through aperture 423 through shroud 424, aperture 454 in plate 452 and into the pool through slots 473. It may be noted that there is no intentional fluid communication between any water inflow through the hydrostatic valve and either of apertures 420, 422 in the bottom of housing 412.

Figure 37:
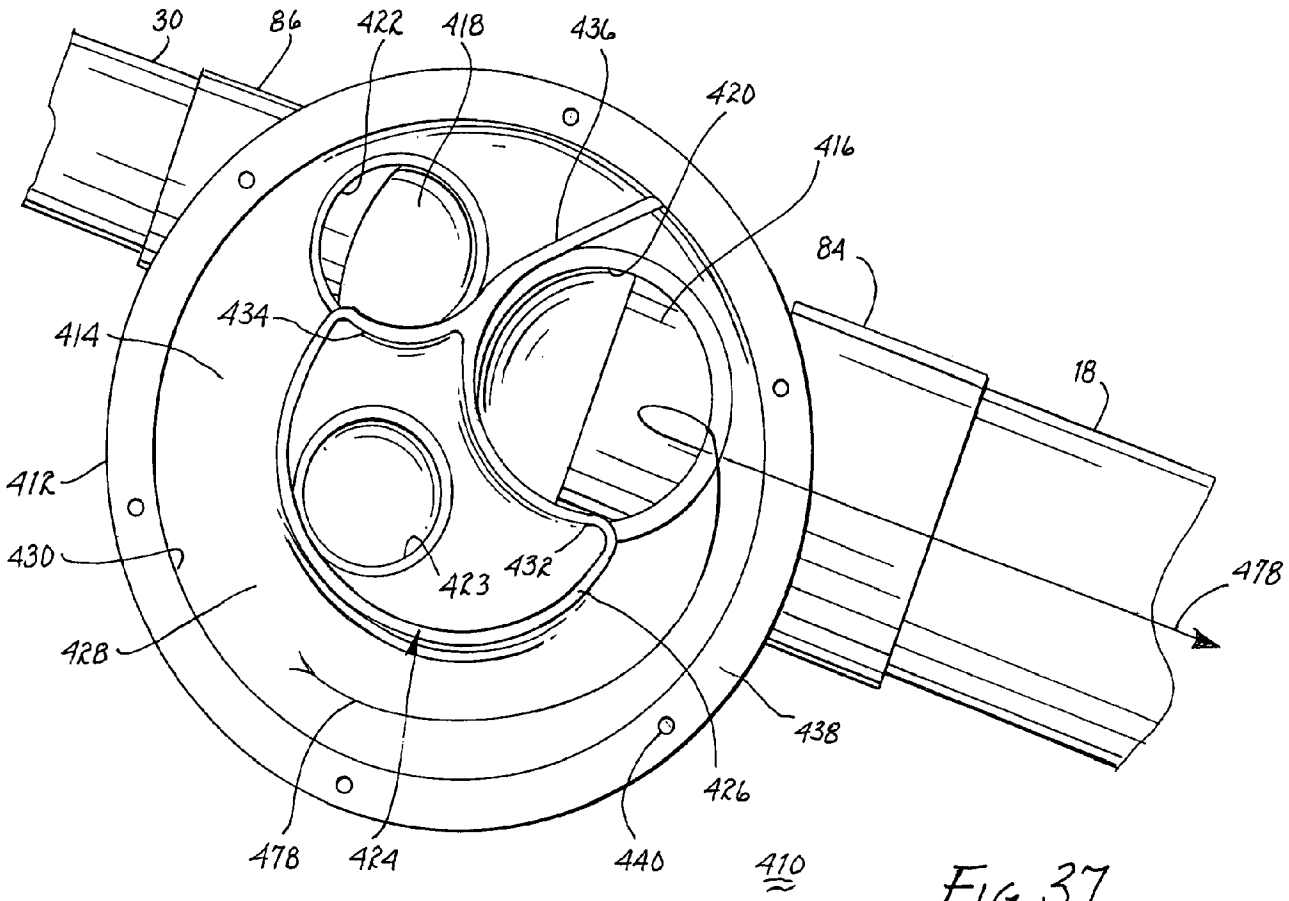
FIG. 37 illustrates the water flow in the sump shown in FIGS. 35 and 36.
Figure 38:
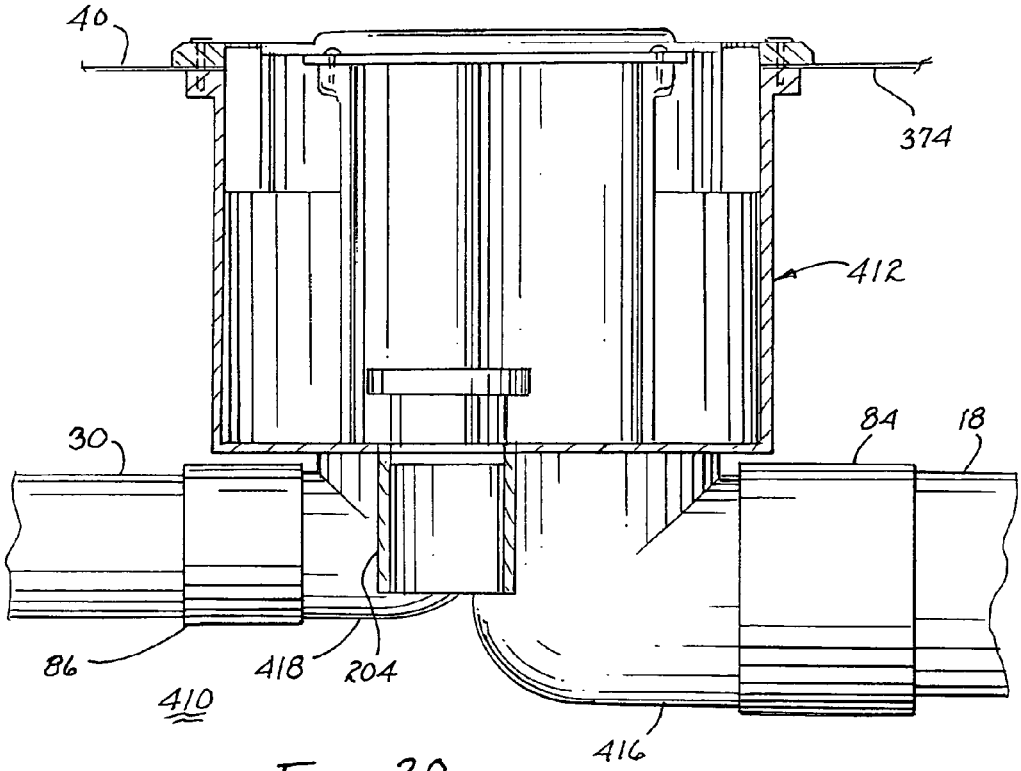
FIG. 38 is a side view of the sump shown in FIGS. 35, 36 and 37.

As depicted by arrow 478 in FIG. 37, water will flow into slot 470 through annular space 428 and into elbow 416 through aperture 420. The primary draw for this waterflow will be toward the counterclockwise end of slot 470 as it is in closest proximity to aperture 420 and there will be little flow of water through aperture 422 into cylindrical sump 410 from bypass line 30.

Figure 39:
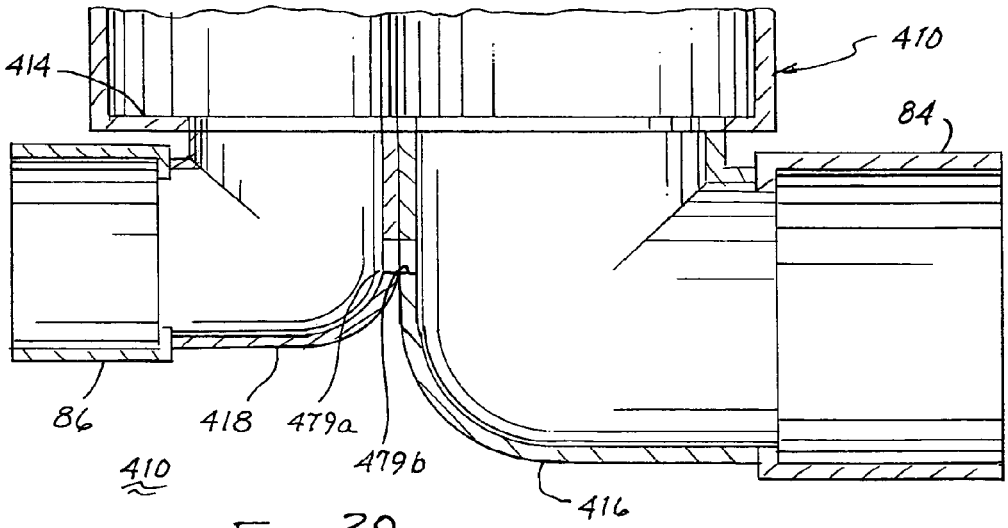
FIG. 39 illustrates waterflow relief between the inlet and outlet conduits attendant the sump shown in FIG. 35.

As particularly illustrated in FIG. 39, elbows 416 and 418 are adjacent one another in contacting relationship. By forming apertures 479*a*, 479*b* at the point of contact, a limited amount of waterflow therebetween will occur which will have no effect upon operation of the variant cylindrical sump. This waterflow is used as part of the pressure test procedure prior to final installation to ensure that the plumbing attendant the sump is leak free. Thereby, a single pressure test can be made.

Figure 40:
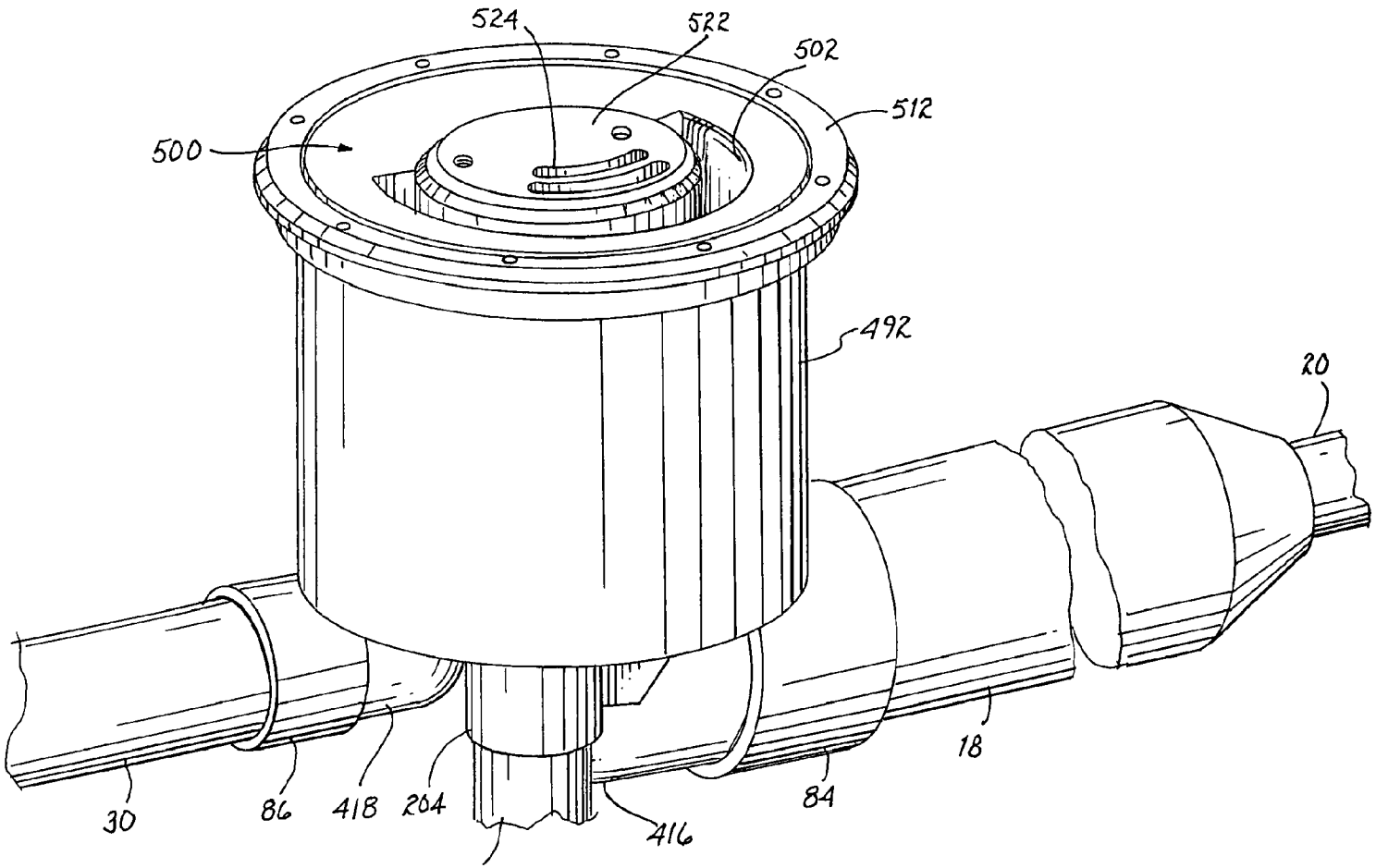
FIG. 40 illustrates a second variant of a preformed cylindrical sump adapted for use in a swimming pool having a liner.
Figure 41:
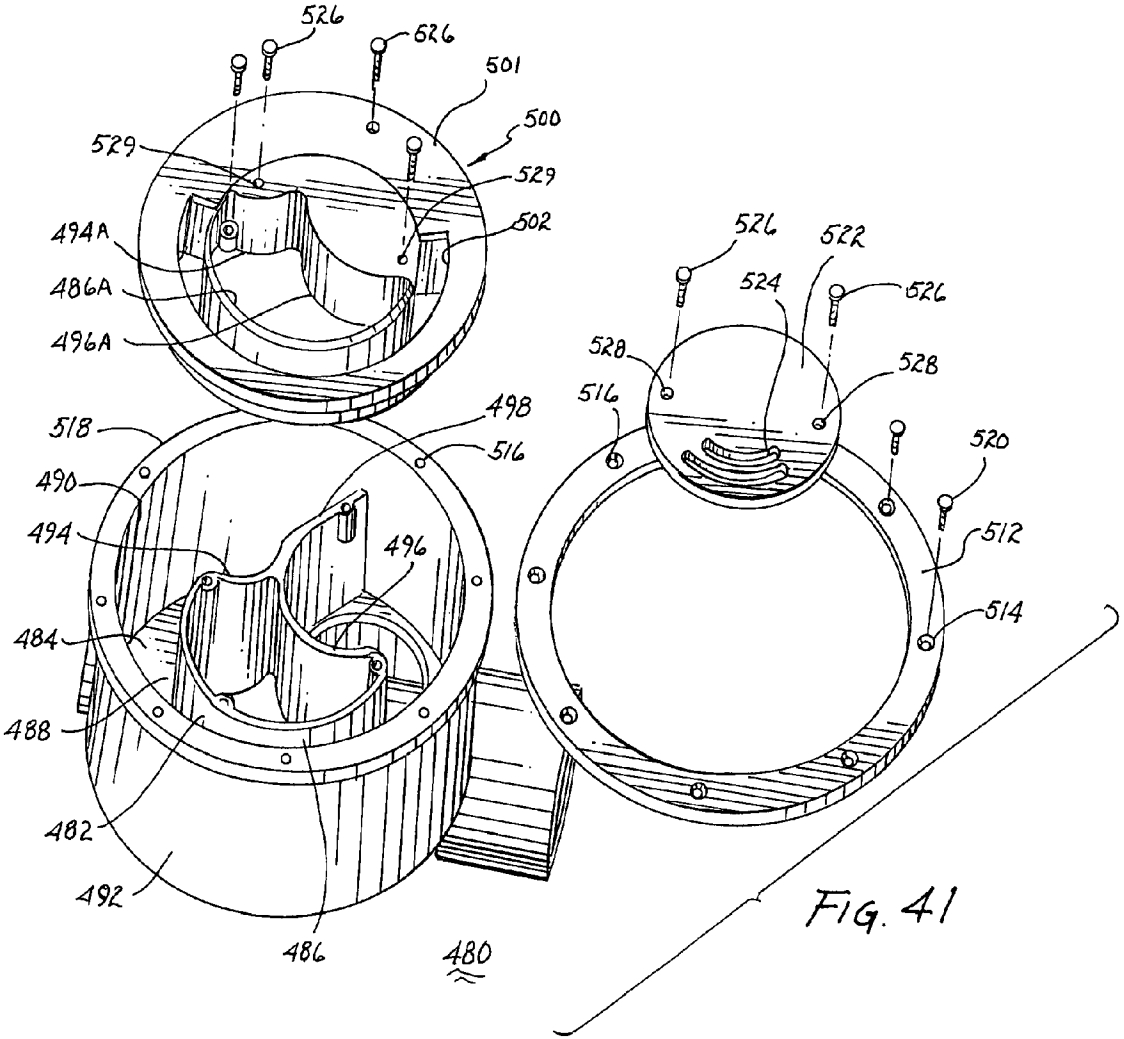
FIG. 41 is a partial exploded view of the sump shown in FIG. 40.
Figure 42:
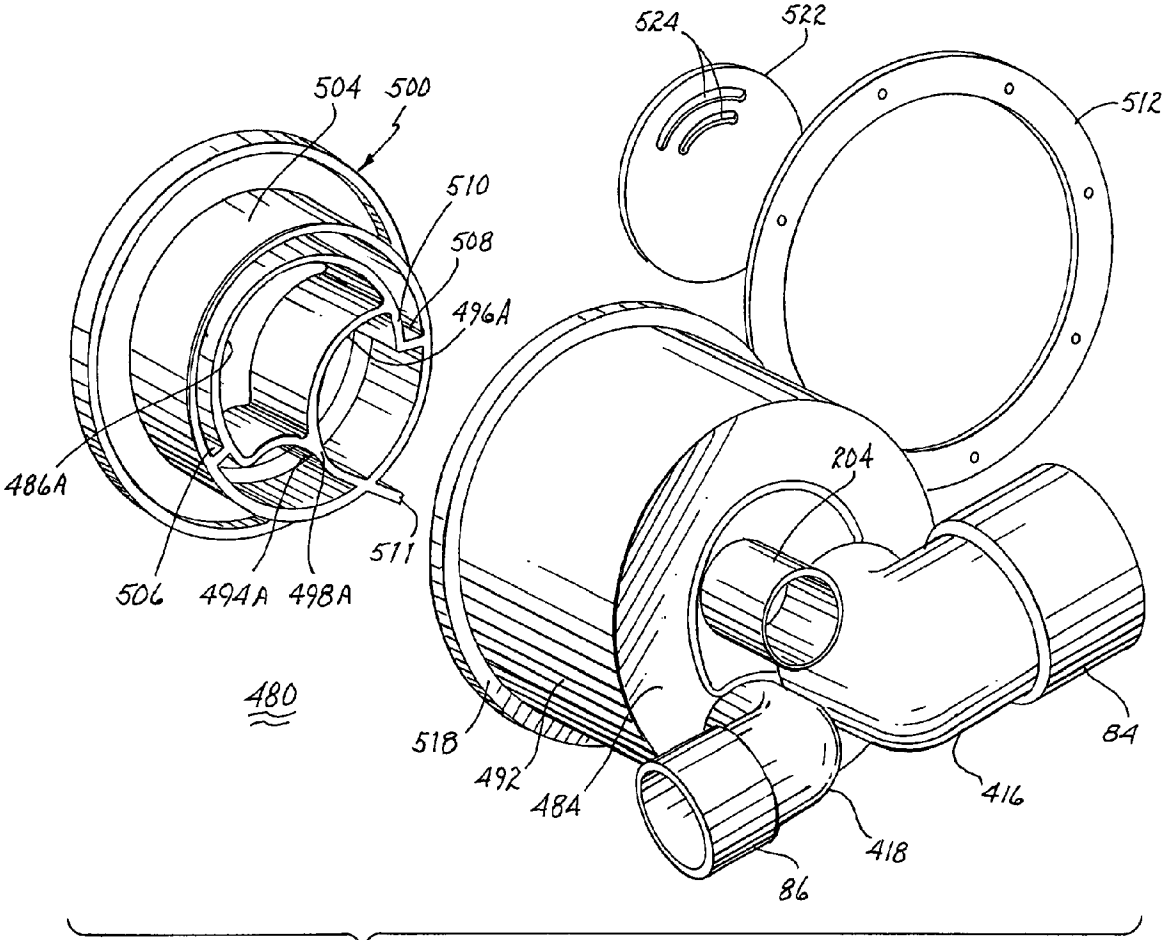
FIG. 42 is a further partial exploded view of the sump shown in FIGS. 40 and 41.

Referring jointly to FIGS. 40, 41 and 42, there is shown a variant cylindrical sump 480 which is quite similar to cylindrical sump 410 except that the internal shrouds are differently configured with certain other changes of elements. Because of such similarity, only the differences will be described in detail and common elements will have common reference numerals.

A shroud 482 is configured similarly to shroud 424 of sump 410 except that it extends only part way upwardly from bottom 484 of cylindrical housing 492. Shroud 482 includes a cylindrical section 486 that defines an annular space 488 with interior surface 490 of housing 492. Section 494 is partly coincident with the aperture in bottom 484 in fluid communication with elbow 418 and boss 86. Section 496 is partly coincident with the aperture in bottom 484 in fluid communication with elbow 416 and boss 84. A wall 498 interconnects the junction of sections 494 and 496 with interior surface 490 of housing 492. Shroud 500, as particularly shown in FIG. 42, includes a ring like plate 501 defining a slot 502 which is an arcuate section. A cylindrical shroud 504 extends from plate 500. It may be noted that the diameter of the plate measures less than the internal diameter of housing 492. A section 486A mates with section 486. Similarly, sections 494A and 496A mate with sections 496 and 494, respectively. Wall 498A mates with wall 498. A wall 506 interconnects shroud 504 and section 486A to define one end of slot 502. Similarly, a wall 508 interconnects with shroud 504 and an extension 510 of section 486A to define the other end of slot 502. A further wall 511 extends laterally from shroud 504 coincident with a corresponding part of wall 498 within housing 492.

As shown in FIG. 41, plate 501 includes an aperture defined by the top edges of sections 486A, 494A and 496A. A ring 512 includes a plurality of holes 514 mating with holes 516 in radially extending lip 518 of housing 492. A plurality of screws 520 secure ring 512 to lip 518 and the vinyl sheet disposed therebetween. Furthermore, ring 512 maintains shroud 500 in place as the ring includes a radially inwardly extending lip 513 for supporting the perimeter of the shroud. A cap 522 includes one or more slots 524 in fluid communication with the aperture defined by sections 486A, 498A and 496A. The cap may be secured to shroud 500 by screws 526 penetrably engaging holes 528 and threadedly engaging holes 529.

In certain installations, it may be important to minimize the depth of a drain sump below the bottom of the deep end of a pool. Referring jointly to FIGS. 43, 44, 45 and 46, there is illustrated a sump particularly configured to meet such requirement and yet provide the benefits discussed above. In particular, the large cross-sectional area of the suction line of sufficient length to prevent passage of a part of an article of clothing or of long hair into the conventional sized suction line is contained completely within the sump. This permits attachment of the conventionally sized suction line directly to a boss of the sump or to other junction element. Certain of the elements illustrated and described herein are equivalent to similar elements of previously described sumps. These elements will be identified by common reference numerals. If required by the site of the installation, a hydrostatic valve can be added to the sump.

Sump 530 is primarily a box or housing 532 open on the top. A peripheral ledge 534 extends about the top somewhat below top edge 536. Boss 84 is in fluid communication with the interior of housing 532 through an aperture 538. As discussed above, boss 84 is in fluid communication with an enlarged suction line 18. Boss 86 is in fluid communication with the interior of housing 532 through an aperture 540; the boss is connected to bypass line 30, as described above. A frame 542 includes a skirt 544 extending into the interior of housing 532 in mating relationship therewith. The frame includes a peripheral ledge 546. A further interior peripheral ledge 548 extends inwardly to support a grate 550. The grate includes a slot 552 disposed along one side opposite to the side adjacent to aperture 538 in housing 532. The configuration of the slot may be as described above. The grate may include a receptacle 554 adjacent the slot. The purpose of this receptacle is to permit a workman to fill the space with plaster or other finishing material used to finish the bottom of the swimming pool. Thereby, only minor elements of sump 530 will be visible to a user of a pool. For identification purposes, this plaster is identified by numeral 556. Alternatively, the receptacle may be omitted and a sheet of plastic may be formed laterally of the slot to the corresponding edges of the grate. As particularly illustrated in FIG. 44, only relatively thin elements of the grate will be apparent to a user of the pool as the bulk of the surface within the perimeter of the grate appears to be of a material and a color the same as that surrounding the grate.

Figure 43:
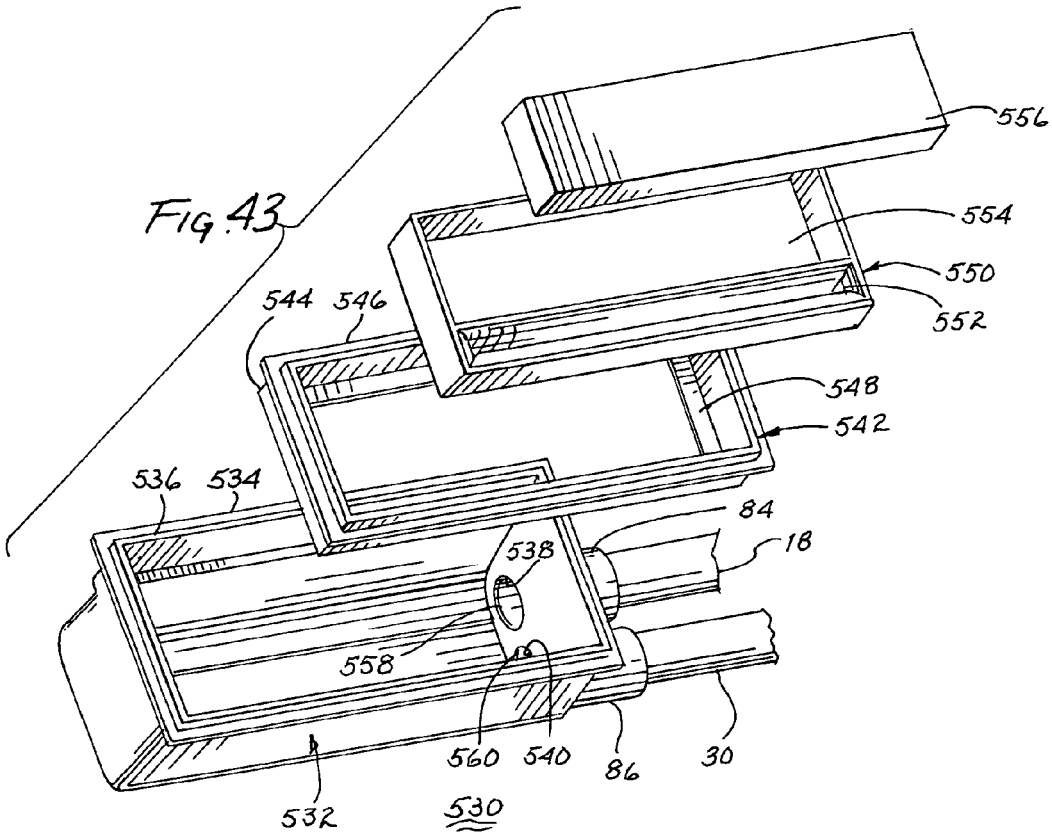
FIG. 43 illustrates the components of a preformed seventh variant of the sump illustrated in FIG. 6.
Figure 44:
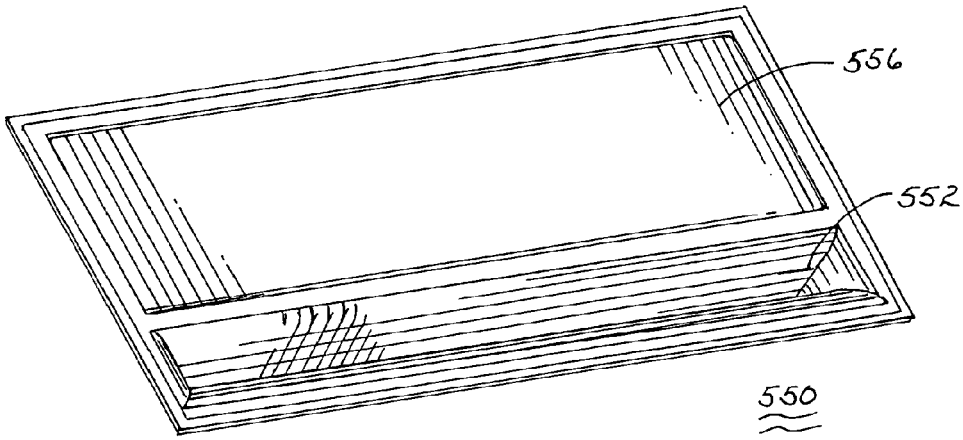
FIG. 44 illustrates the grate usable with the sump shown in FIG. 43.

Whenever any sump of the types described herein is installed, the piping/conduits associated therewith must be pressure tested prior to final completion of ensure that there are no leaks. Such pressure testing is generally performed by plugging the outlet in the sump to the pump and the inlet in the sump for the bypass line. Thereafter, pressure testing is conducted. This is common practice and well known to those skilled in the art. Although not specifically described with respect to the previously disclosed sumps, the opening attendant bosses 84 and 86 would normally include internal threads to permit threaded attachment of plugs. Such threaded attachment is illustrated in FIG. 43. In particular, threads 558 are associated with aperture 538 and threads 560 are associated with aperture 540. It is to be understood that similar structure would exist for the previously described and to be described sumps.

Figure 45:
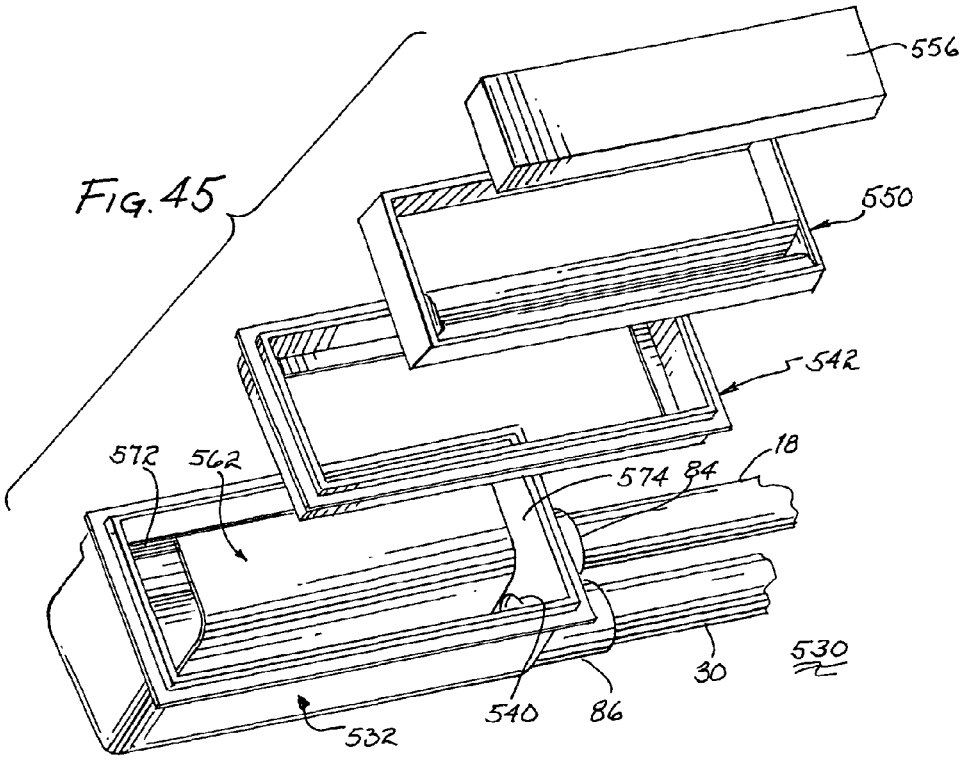
FIG. 45 is an exploded view illustrating a modification of the sump shown in FIG. 43.
Figure 46:
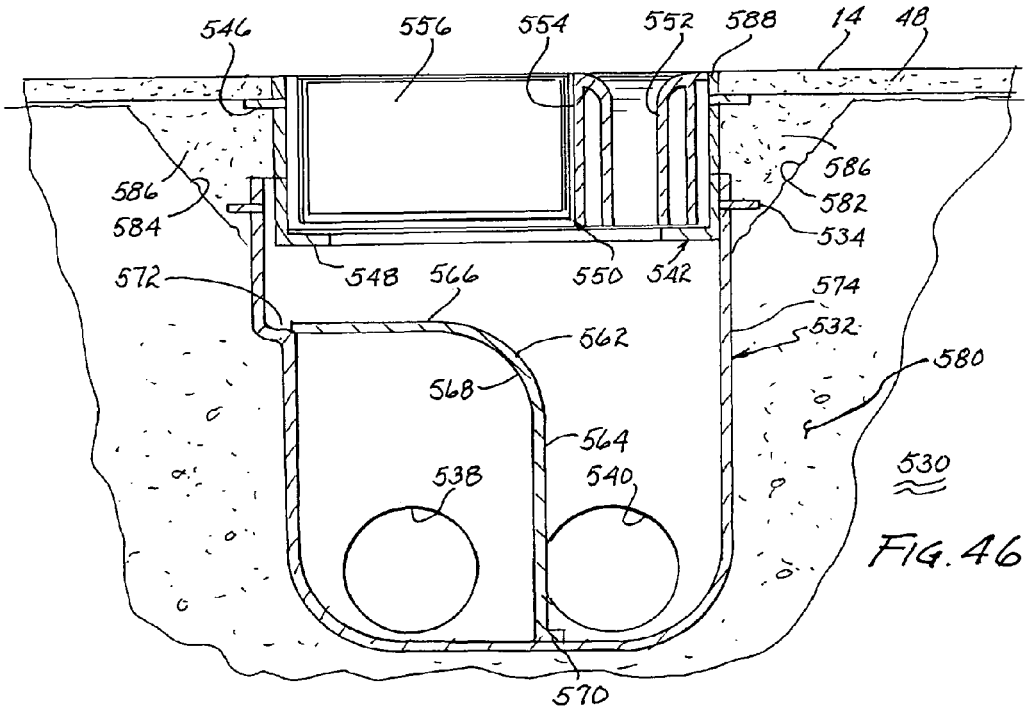
FIG. 46 is a cross sectional view of the sump shown in FIG. 45.

As particularly shown in FIGS. 45 and 46, the flow path from slot 552 to aperture 538 attendant boss 84 can be lengthened by incorporating a shroud 562. Thus, the total length of the above described large cross-sectional area suction line can be wholly contained within sump 530. Because of the requirement for pressure testing, at least upon installation of sump 530, shroud 562 must be removable prior to such testing in order to have access to aperture 538 and the shroud must be attachable subsequent to such testing. As illustrated, the shroud is primarily a sheet of plastic having two planar sections 564 and 566 joined to one another by a curved section 568 to place the planar sections orthogonal to one another. A lip 570 extends along the bottom edge of section 564 to permit attachment to the bottom of box 532 by screws or other attachment means. The edge of planar section 566 rests upon a shelf 572 formed in the housing. With such shroud, a flow gradient will occur along slot 552 in that most of the flow will be toward the end of the slot proximate the opening of the shroud and lesser flow will occur at the other end of the slot adjacent the junction of the shroud with wall 574 of the box. With such installation of shroud 562, the suction line attached to sump 532 may be of conventional cross-sectional area and the length of low velocity flow from grate 550 will not be compromised.

As particularly shown in FIG. 46, sump 530 may be mounted within cementitious material 580 forming the shell of the pool. The upper end of housing 532 is generally left free of cementitious material, as indicated by lines of demarcation 582, 584. Thereafter, setting material 586 is laid to envelope ledge 534 and a mechanical bond is formed therewith to solidly mount housing 532. Frame 542 is inserted within housing 532 to a depth commensurate with the top edge 588 of the frame being essentially in the plane corresponding with bottom 14 of the pool. It is understood that a layer of plaster or coating 48 provides the finished surface at the bottom of the pool. As discussed above, receptacle 554 of grate 550 may be filled with plaster 556 to minimize the color/texture discontinuity of the grate and the adjacent plaster surface. As illustrated, ledge 546 of frame 542 is enveloped with setting material 586 and plaster 556 may also be in contact therewith to firmly lodge the frame in place.

Figure 47:
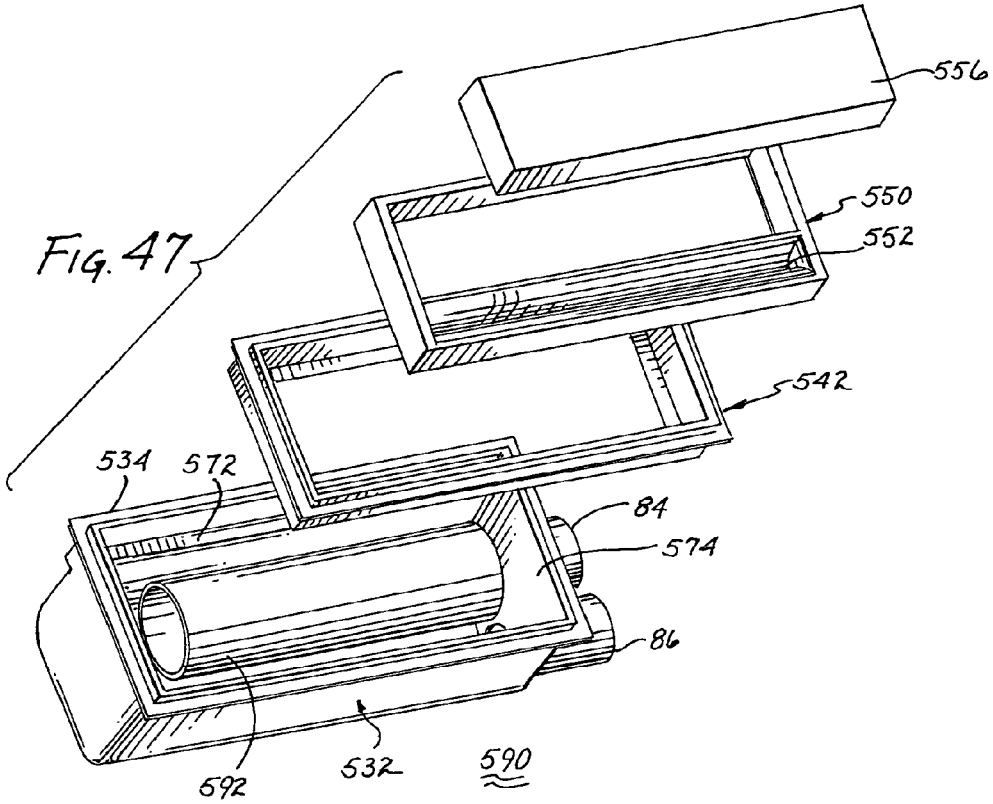
FIG. 47 is an exploded view of a modification of the sump shown in FIG. 43.
Figure 48:
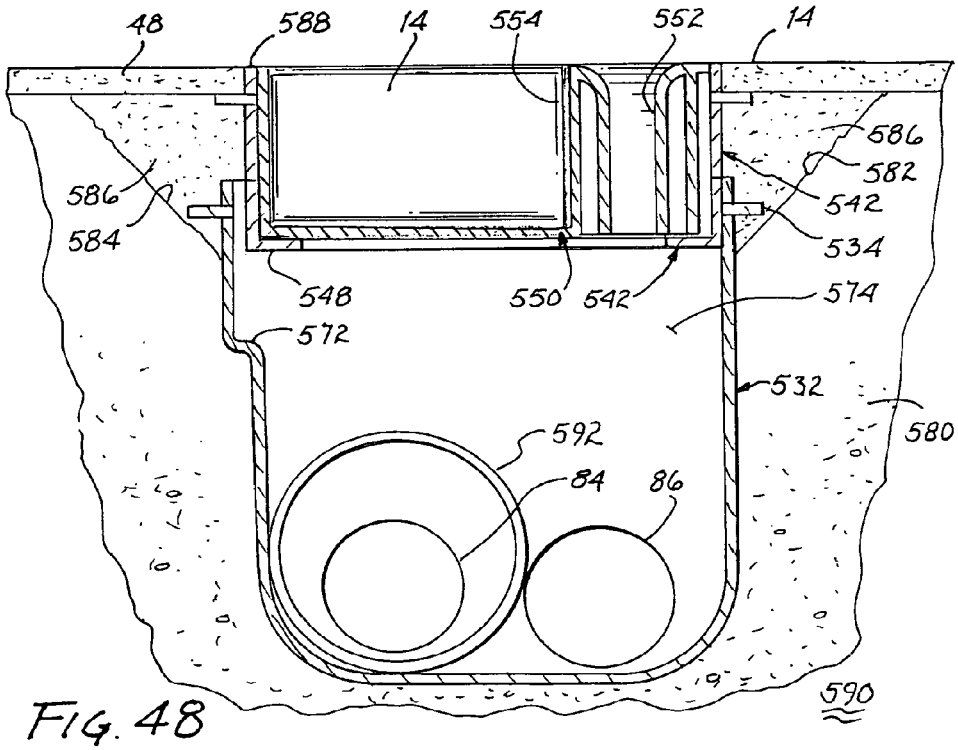
FIG. 48 is a cross sectional view of the sump shown in FIG. 47.

FIGS. 47 and 48 illustrate a further variant sump 590, which sump is similar to sump 530 except for the channeling of water into boss 84. Accordingly, these differences will be primarily reviewed below. For common elements, common reference numerals will be used. To increase the flow path of water entering through slot 552 to boss 84, a shroud in the form of a tube 592 is attached to and extends from wall 574 of housing 532 in generally overlapping relationship with the opening of boss 84. This tube serves the same function as shroud 562 discussed above and the suction line attached to boss 84 may be of conventional cross-sectional area without compromising the benefits of low velocity flow. Installation of sump 590 is essentially duplicative of the installation for sump 530, as shown in FIG. 48. Accordingly, a duplicative description is not necessary.

Figure 49:
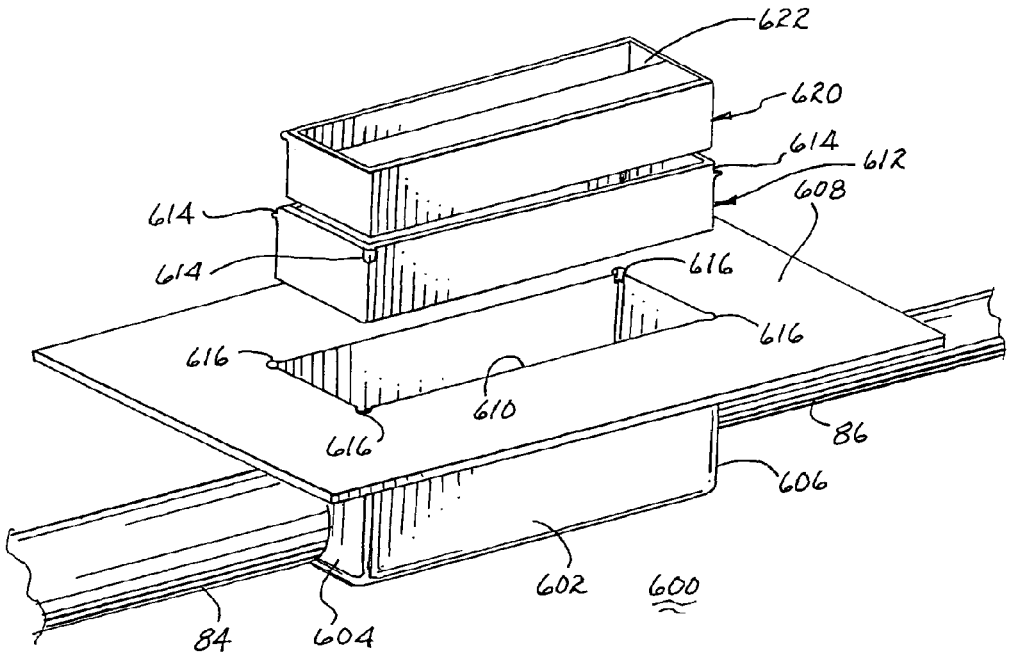
FIG. 49 illustrates a preformed eighth variant of the sump shown in FIG. 6.
Figure 50:
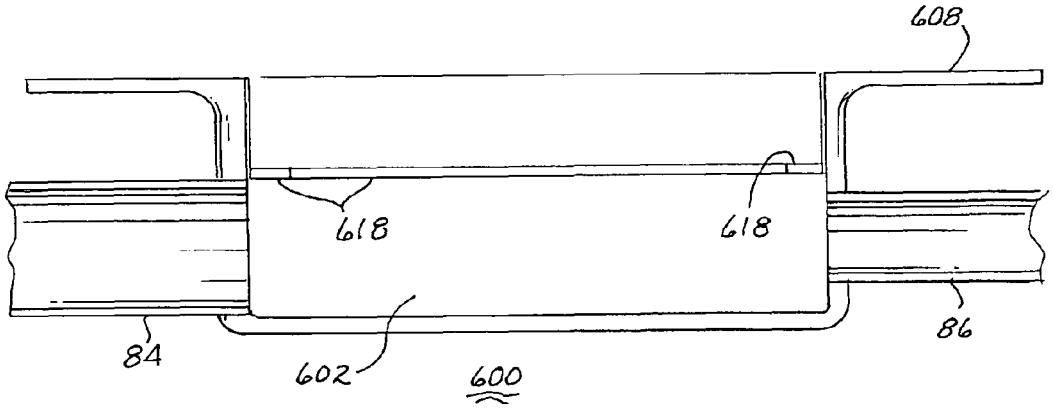
FIG. 50 is a partial cross sectional view of the sump shown in FIG. 49.

Referring jointly to FIGS. 49 and 50 there is illustrated a further variant sump 600 particularly adapted for use in a pool or spa made of a fiberglass shell and disposed below the bottom of the pool or spa. Sump 600 includes a housing 602 having a boss 84 extending from end 604. Boss 86 extends from opposite end 606. The illustrated plate 608 is a part of the pool/spa shell and includes an aperture 610 dimensioned to correspond with the interior dimensions of housing 602. During lay up of the pool/spa shell, housing 502 and bosses 84 and 86 may be layed up commensurate therewith. Thereby, at the time of installation of the pool/spa, a workman need only attach the suction line and the bypass line to bosses 84 and 86, respectively.

After installation of the pool/spa at the site, frame 612 is inserted into housing 602 through aperture 610 and retained in place by nubs 614 engaging corresponding depressions 616 disposed at each corner of aperture 610. The frame includes a shelf or ledge 618 extending internally at the bottom of the frame. A grate 620 includes a slot 622 of the type described above. The grate is dimensioned to slide into frame 612 and rest upon ledge 618 of the frame. Thereby, slot 622 provides a channel for water from the pool/spa to flow into housing 602 and thereafter into boss 84. It is to be understood that sump 600 may be mounted in a pool formed of cementitious material or in a pool having a plastic liner. In the latter event, various mounting procedures well known to those skilled in the art would be employed.

The invention claimed is:

1. A sump for a swimming pool drain comprising:

a sump housing in a bottom of a swimming pool;

a grate disposed on the sump, the grate comprising one or more slots therethrough;

a first suction line comprising a first diameter coupled to the sump housing at a first end of the first suction line and coupled to a second suction line at a second end of the first suction line opposite the first end, the second suction line comprising a second diameter smaller than the first diameter;

a low velocity flow zone extending from the one or more slots in the grate and through the first suction line to the second end of the first suction line, the low velocity flow zone having a total length of not less than about 24 inches from all of each of the one or more slots to the second end of the first suction line, the first diameter being sufficiently larger than the diameter of the second suction line so that when a flow velocity through the second suction line is approximately 6 feet per second a flow velocity within the first suction line is approximately 1.5 feet per second or less and a flow velocity throughout the low velocity flow zone is approximately 1.5 feet per second or less throughout the low velocity flow zone.

2. The sump of claim 1, further comprising a frame having a ledge mounted within the sump housing and the grate comprising an opening along one side of the sump housing.

3. The sump of claim 1, wherein the sump housing is integrally formed as part of the bottom of the swimming pool.

4. The sump of claim 3, wherein the sump housing is integrally formed of a cementitious material as part of the swimming pool or the sump housing is integrally formed of fiberglass as part of a one-piece fiberglass pool.

5. The sump of claim 4, wherein the enlarged suction line is coupled to the sump housing at at least one of a bottom surface and a side surface of the housing.

6. A sump for a swimming pool drain comprising:

a sump housing for the swimming pool drain, the sump housing comprising a grate with one or more slots therethrough;

a drain suction line comprising a first diameter;

an enlarged suction line coupled between the sump housing and the drain suction line, the enlarged suction line comprising a second diameter greater than the first diameter, wherein the distance from all of each of the one or more slots in the grate to the drain suction line is at least 24 inches;

wherein the enlarged suction line is sized such that the water passing through the enlarged suction line into the drain suction line passes at a velocity in the drain suction line faster than a velocity of the water in the enlarged suction line.

7. The sump of claim 6, wherein the velocity in the drain suction line is about 6 feet per second and the velocity in the enlarged suction line is about 1.5 feet per second.

8. The sump of claim 6, further comprising a frame having a ledge mounted within the sump housing and the grate comprising an opening along one side of the sump housing.

9. The sump of claim 6, wherein the enlarged suction line is coupled to the sump housing at at least one of a bottom surface and a side surface of the housing.

10. The sump of claim 1, wherein the low velocity flow zone is configured such that when a water flow rate through the first suction line and the second suction line is approximately 60 gallons per minute, the flow velocity through the low velocity flow zone is approximately 1.5 feet per second or less.

11. The sump of claim 6, wherein the enlarged suction line is configured such that when a water flow rate through the drain suction line and the enlarged suction line is approximately 60 gallons per minute, the water passes through the enlarged suction line at a velocity of approximately 1.5 feet per second or less.

* * * * *